US006509144B1

(12) United States Patent
Reed et al.

(10) Patent No.: US 6,509,144 B1
(45) **Date of Patent: *Jan. 21, 2003**

(54) FRAGMENTABLE ELECTRON DONOR COMPOUNDS COMBINED WITH BROAD BLUE SPECTRAL SENSITIZATION

(75) Inventors: Kenneth J. Reed, Rochester, NY (US); Joseph P. Pepe, Penfield, NY (US); James A. Friday, Rochester, NY (US); Jon N. Eikenberry, Rochester, NY (US); Yun C. Chang, Rochester, NY (US); Annabel A. Muenter, Rochester, NY (US); Jerome R. Lenhard, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/236,821

(22) Filed: Jan. 25, 1999

(51) Int. Cl.[7] ..... G03C 1/10; G03C 1/12

(52) U.S. Cl. ..... 430/567; 430/569; 430/600; 430/572; 430/574; 430/577; 430/578; 430/580; 430/581; 430/583; 430/586

(58) Field of Search ..... 430/567, 569, 430/600, 572, 574, 581, 577, 586, 579, 580, 583, 578

(56) References Cited

U.S. PATENT DOCUMENTS

| | | | | | |
|---|---|---|---|---|---|
| 5,460,928 | A | | 10/1995 | Kam-Ng et al. | 430/503 |
| 5,576,157 | A | | 11/1996 | Eikenberry et al. | 430/503 |
| 5,747,235 | A | | 5/1998 | Farid et al. | 430/583 |
| 5,747,236 | A | | 5/1998 | Farid et al. | 430/583 |
| 6,010,841 | A | * | 1/2000 | Farid et al. | 430/583 |
| 6,054,260 | A | * | 4/2000 | Adin et al. | 430/583 |
| 6,066,443 | A | * | 5/2000 | Dobles et al. | 430/583 |
| 6,153,371 | A | * | 11/2000 | Farid et al. | 430/581 |

FOREIGN PATENT DOCUMENTS

| | | | | |
|---|---|---|---|---|
| EP | 0 677 782 A1 | | 4/1995 | G03C/7/30 |
| EP | 0 786 691 A1 | | 1/1997 | G03C/1/10 |
| EP | 786692 | * | 7/1997 | G03C/1/16 |

* cited by examiner

*Primary Examiner*—Janet Baxter
*Assistant Examiner*—Amanda C. Walke
(74) *Attorney, Agent, or Firm*—Edith A. Rice

(57) ABSTRACT

This invention comprises a photographic element comprising a support and at least one blue sensitive silver halide emulsion layer containing a tabular grain silver halide emulsion, or an emulsion in which the halide content is at least 50% chloride and no more than 5% iodide, wherein the emulsion is spectrally sensitized with at least one dye providing a peak sensitization between 446 and 500 nm and at least one dye providing a peak sensitization between 400 and 445 nm and additionally sensitized with a fragmentable electron donor of the formula: X—Y'. or an electron donor which contains an —XY' moiety;
wherein X is an electron donor moiety, Y' is a leaving proton H or a leaving group Y, with the proviso that if Y' is H a base, $\beta^-$, is covalently linked directly or indirectly to X. and wherein:

1) X—Y' has an oxidation potential between 0 and about 1.4 V; and
2) the oxidized form of X—Y' fragments to give the radical $X^{\bullet}$ and the leaving fragment Y'; and, optionally,
3) the radical $X^{\bullet}$ has an oxidation potential $\leqq -0.7$V (that is, equal to or more negative than about −0.7 V).

47 Claims, 1 Drawing Sheet

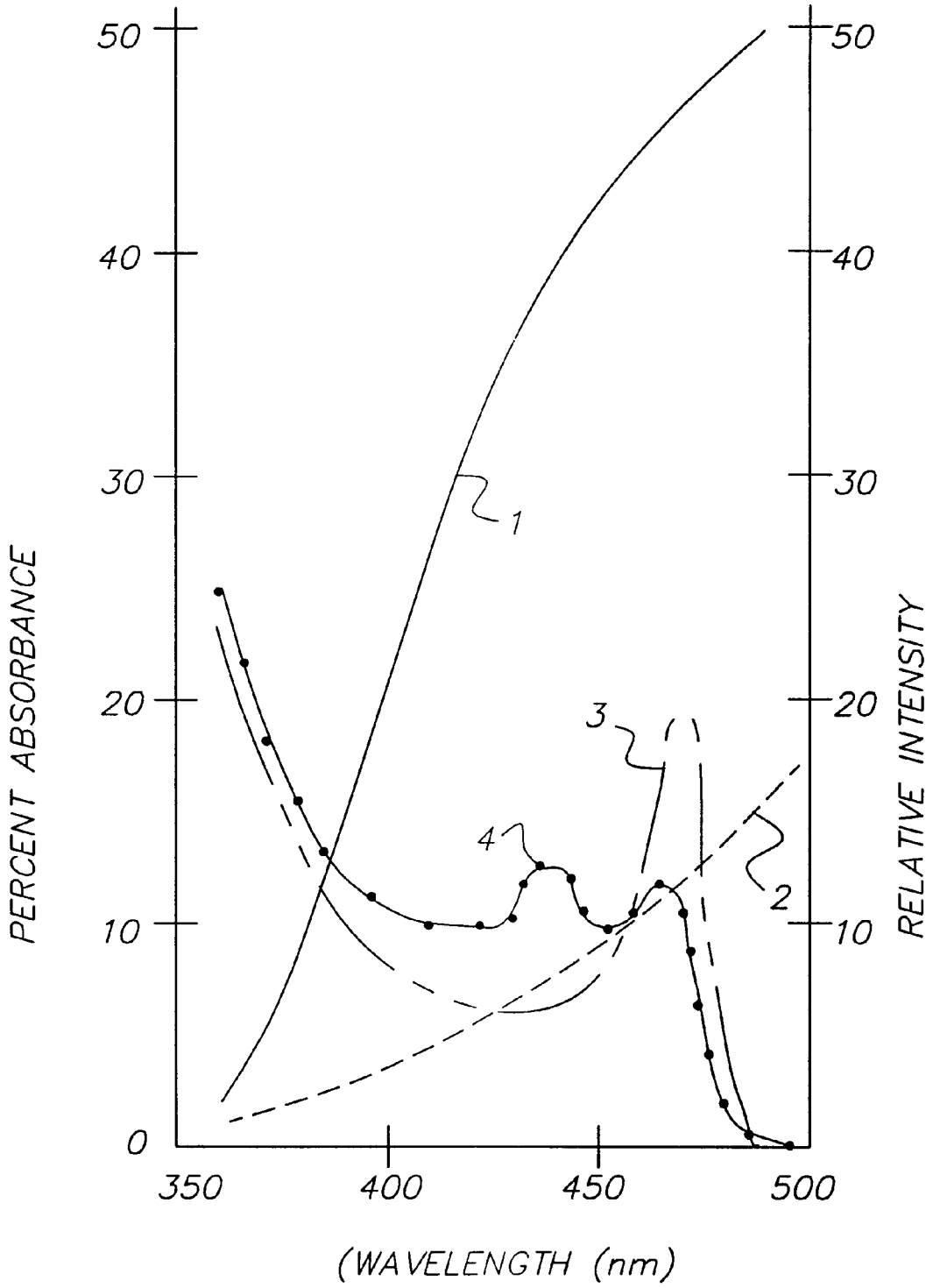
50
40
30
20
10
0
PERCENT ABSORBANCE
50
40
30
20
10
RELATIVE INTENSITY
1
2
3
4
350
400
450
500
(WAVELENGTH (nm)

FRAGMENTABLE ELECTRON DONOR COMPOUNDS COMBINED WITH BROAD BLUE SPECTRAL SENSITIZATION

FIELD OF THE INVENTION

This invention relates to a photographic element and in particular a photographic element comprising at least one layer sensitized to blue light.

BACKGROUND OF THE INVENTION

The use of two or more spectral sensitizing dyes that respond to a discrete spectral region (red, green or blue) when adsorbed onto the surface of silver halide emulsion grains is well known in the literature. The primary benefit derived from the use of more than one spectral dye is the improvement in color reproduction and saturation in the final recorded image. In the red and green region of the visible spectrum, where the photon flux output of a daylight 5500° K. light source is relatively flat, the use of two or more spectral sensitizing dyes does not result in an apparent emulsion speed loss. In fact, speed gains are often observed. Since the total amount of sensitizing dye that can be accommodated on the emulsion grain surface is fixed by the molar surface area of the grain (and the molecular area of the dye) the presence of a second shorter wavelength dye absorbing light in a region of equal photon flux to that of the complimentary longer wavelength dye compensates (or may even overcompensate) for the reduced amount of first dye that is used.

However, in the blue region of the spectrum (400 to 500 nm), the flux of light from typical daylight light sources (and tungsten light sources) increases with wavelength (FIG. 1). Combination of a shorter wavelength absorbing dye (e.g. 440 nm) with a longer wavelength absorbing dye (e.g. 470) will result in less light being absorbed by the silver halide emulsion compared to the case of the longer wavelength dye used alone. This will result in a real speed loss-typically a magnitude of 0.1 to 0.2 log E (26 to 37%). In this situation, emulsion speed is being sacrificed for color reproduction.

The need to use a shorter blue wavelength dye in combination with longer wavelength blue dye to enable faithful color reproduction is particularly relevant for tabular emulsions and for 3 dimensional morphology (3D) emulsions that are predominantly AgCl. As used herein, the term "3D grain" refers to non-tabular morphologies, for example cubes, octahedra, rods and spherical grains, and to tabular grains having an aspect ratio of less than 2. AgBr or AgBrI 3D emulsions absorb a substantial amount of blue light in the volume of the emulsion grain and sensitizing dyes can only add additional light absorption in the longer blue wavelengths. However, for emulsions of tabular morphology or high chloride 3D emulsions, the major portion of blue light absorption must be provided by sensitizing dyes since only a small amount of this light absorption is contributed by the volume light absorption of these grains. For tabular grains, the amount of this volume light absorption is dependent on the iodide content and the thickness of the tabular emulsion grain. Thin tabular emulsions, tabular emulsions with little or no iodide content, and AgCl emulsions with little or no bromide or iodide content are particularly deficient in blue light absorption and thus especially require the combination of shorter wavelength and longer wavelength absorbing blue dyes to give faithful color reproduction. Thin tabular emulsions have advantages related to savings in silver usage. AgBrI tabular emulsions with low iodide, AgBr tabular emulsions, and high chloride emulsions of any morphology all have advantages related to more rapid photographic processing with lower replenishment rates. Thus, it is desirable to have a technology that allows these types of emulsions to be used as blue sensitive layers without compromising speed or color reproduction.

SUMMARY OF THE INVENTION

We have found that the use of fragmentable electron donor (FED) compounds in conjunction with a broad blue spectral sensitization (i.e. two dyes, one absorbing near 440 nm and the other near 470 nm) can overcome the speed loss associated with this type of blue sensitization.

One aspect of this invention comprises a photographic element comprising a support and at least one blue sensitive silver halide emulsion layer containing a tabular grain silver halide emulsion spectrally sensitized with at least one dye providing a peak sensitization between 446 and 500 nm and at least one dye providing a peak sensitization between 400 and 445 nm and additionally sensitized with a fragmentable electron donor of the formula: X—Y' or a an electron donor that contains an —XY' moiety;

wherein

X is an electron donor moiety, Y' is a leaving proton H or a leaving group Y, with the proviso that if Y' is H a base, $\beta^-$, is covalently linked directly or indirectly to X and wherein:

1) X—Y' has an oxidation potential between 0 and about 1.4 V; and
2) the oxidized form of X—Y' fragments to give the radical $X^{\bullet}$ and the leaving fragment Y'; and, optionally,
3) the radical $X^{\bullet}$ has an oxidation potential $\leqq -0.7$ V (that is, equal to or more negative than about −0.7 V).

Another aspect of this invention comprises a photographic element comprising a support and at least one blue sensitive silver halide emulsion layer containing a silver halide emulsion in which the halide content is at least about 50% chloride and no more than 5% iodide, wherein the emulsion is spectrally sensitized with at least one dye providing a peak sensitization between 446 and 500 nm and at least one dye providing a peak sensitization between 400 and 445 nm and is additionally sensitized with a fragmentable electron donor of the formula: X—Y'. or an electron donor which contains an —XY' moiety;

wherein

X is an electron donor moiety, Y' is a leaving proton H or a leaving group Y, with the proviso that if Y' is H a base, $\beta^-$, is covalently linked directly or indirectly to X. and wherein:

1) X—Y' has an oxidation potential between 0 and about 1.4 V; and
2) the oxidized form of X—Y' fragments to give the radical $X^{\bullet}$ and the leaving fragment Y'; and, optionally,
3) the radical $X^{\bullet}$ has an oxidation potential $\leqq -0.7$V (that is, equal to or more negative than about −0.7V).

BRIEF DESCRIPTION OF THE DRAWING

FIG. 1 shows the relative light intensity distribution from typical light sources used in photography in the wavelength region from 350 to 500 nm, together with the light absorptance of blue dyes on a tabular AgBrI emulsion. Curve 1 (solid line) is the relative light intensity of typical daylight and Curve 2 (dashed line) is the relative light intensity of a 3200 K tungsten light source. Curve 3 (dashed and dotted line) is the light absorptance of a single long wavelength absorbing blue sensitizing dye on an AgBrI tabular emulsion and Curve 4 (dotted line) is the light absorptance of a broad blue dye combination on the same emulsion.

DETAILED DESCRIPTION OF THE INVENTION

In accordance with this invention a silver halide emulsion contains a fragmentable electron donating (FED) compound which enhances the sensitivity of the emulsion. The fragmentable electron donating compound is of the formula: X—Y' or a compound which contains a moiety of the formula —X—Y';

wherein

X is an electron donor moiety, Y' is a leaving proton H or a leaving group Y, with the proviso that if Y' is H a base, $\beta^-$, is covalently linked directly or indirectly to X. and wherein:

1) X—Y' has an oxidation potential between 0 and about 1.4 V; and
2) the oxidized form of X—Y' undergoes a bond cleavage reaction to give the radical $X^\bullet$ and the leaving fragment Y'; and, optionally,
3) the radical $X^\bullet$ has an oxidation potential $\leqq -0.7$ V (that is, equal to or more negative than about −0.7 V).

In embodiments of the invention wherein Y' is a proton, a base, $\beta^-$, is covalently linked directly or indirectly to X.

Compounds wherein X—Y' meets criteria (1) and (2) but not (3) are capable of donating one electron and are referred to herein as fragmentable one-electron donating compounds. Compounds which meet all three criteria are capable of donating two electrons and are referred to herein as fragmentable two-electron donating compounds.

In this patent application, oxidation potentials are reported as "V" which represents "volts versus a saturated calomel reference electrode".

In embodiments of the invention in which Y' is Y, the following represents the reactions that are believed to take place when X—Y undergoes oxidation and fragmentation to produce a radical $X^\bullet$, which in a preferred embodiment undergoes further oxidation.

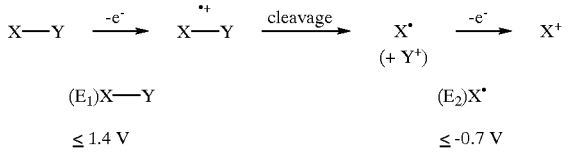

The structural features of X—Y are defined by the characteristics of the two parts, namely the fragment X and the fragment Y. The structural features of the fragment X determine the oxidation potential of the X—Y molecule and that of the radical $X^\bullet$, whereas both the X and Y fragments affect the fragmentation rate of the oxidized molecule $X—Y^{\bullet+}$.

In embodiments of the invention in which Y' is H, the following represents the reactions believed to take place when the compound X—H undergoes oxidation and deprotonation to the base, $\beta^-$, to produce a radical $X^\bullet$, which in a preferred embodiment undergoes further oxidation.

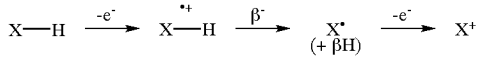

Preferred X groups are of the general formula:

(I)

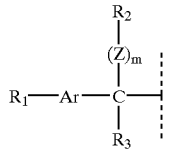

(II)

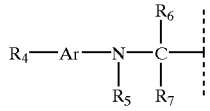

(III)

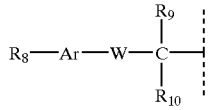

or (IV)

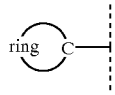

The symbol "R" (that is R without a subscript) is used in all structural formulae in this patent application to represent a hydrogen atom or an unsubstituted or substituted alkyl group.

In structure (I):

m=0, 1;

Z=O, S, Se, Te;

Ar=aryl group (e.g., phenyl, naphthyl, phenanthryl, anthryl); or heterocyclic group (e.g., pyridine, indole, benzimidazole, thiazole, benzothiazole, thiadiazole, etc.);

$R_1$=R, carboxyl, amide, sulfonamide, halogen, $NR_2$, $(OH)_n$, $(OR')_n$, or $(SR)_n$;

R'=alkyl or substituted alkyl;

n=1–3;

$R_2$=R, Ar';

$R_3$=R, Ar';

$R_2$ and $R_3$ together can form 5- to 8-membered ring;

$R_2$ and Ar= can be linked to form 5- to 8-membered ring;

$R_3$ and Ar= can be linked to form 5- to 8-membered ring;

Ar'=aryl group such as phenyl, substituted phenyl, or heterocyclic group (e.g., pyridine, benzothiazole, etc.)

R=a hydrogen atom or an unsubstituted or substituted alkyl group.

In structure (II):

Ar=aryl group (e.g., phenyl, naphthyl, phenanthryl); or heterocyclic group (e.g., pyridine, benzothiazole, etc.);

$R_4$=a substituent having a Hammett sigma value of −1 to +1, preferably −0.7 to +0.7, e.g., R, OR, SR, halogen, CHO, C(O)R, COOR, $CONR_2$, $SO_3R$, $SO_2NR_2$, $SO_2R$, SOR, C(S)R, etc;

$R_5$=R, Ar'

$R_6$ and $R_7$=R, Ar'

$R_5$ and Ar= can be linked to form 5- to 8-membered ring;

$R_6$ and Ar= can be linked to form 5- to 8-membered ring (in which case, $R_6$ can be a hetero atom);

$R_5$ and $R_6$ can be linked to form 5- to 8-membered ring;

$R_6$ and $R_7$ can be linked to form 5- to 8-membered ring;

Ar'=aryl group such as phenyl, substituted phenyl, heterocyclic group;

R=hydrogen atom or an unsubstituted or substituted alkyl group.

A discussion on Hammett sigma values can be found in C. Hansch and R. W. Taft *Chem. Rev.* Vol 91, (1991) p 165, the disclosure of which is incorporated herein by reference.

In structure (III):

W=O, S, Se;

Ar=aryl group (e.g., phenyl, naphthyl, phenanthryl, anthryl); or heterocyclic group (e.g., indole, benzimidazole, etc.)

$R_8$=R, carboxyl, $NR_2$, $(OR)_n$, or $(SR)_n$ (n=1–3);

$R_9$ and $R_{10}$=R, Ar';

$R_9$ and Ar═ can be linked to form 5- to 8-membered ring;

Ar'=aryl group such as phenyl substituted phenyl or heterocyclic group;

R=a hydrogen atom or an unsubstituted or substituted alkyl group.

In structure (IV):

"ring" represents a substituted or unsubstituted 5-, 6- or 7-membered unsaturated ring, preferably a heterocyclic ring.

The following are illustrative examples of the group X of the general structure I:

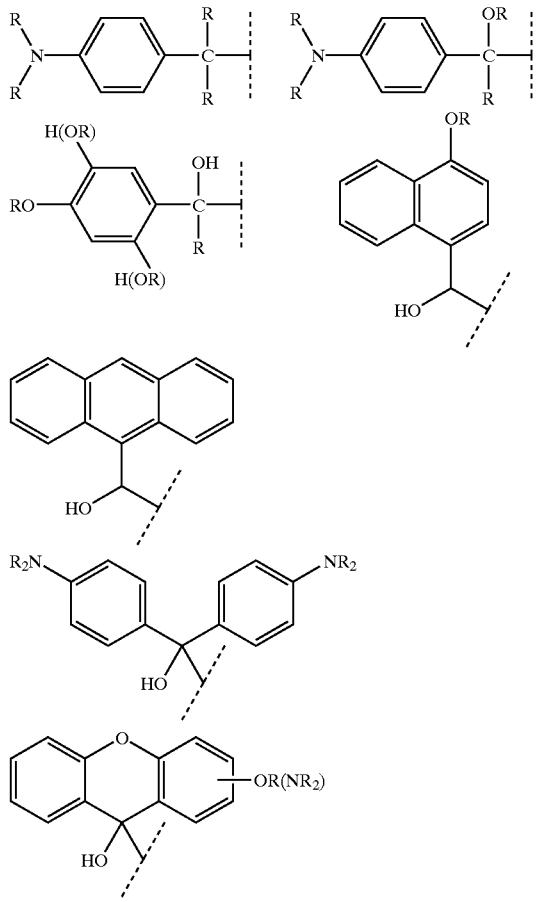

-continued

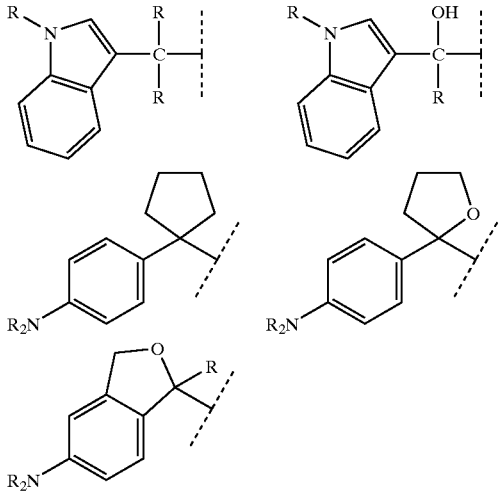

In the structures of this patent application a designation such as —OR($NR_2$) indicates that either —OR or —$NR_2$ can be present.

The following are illustrative examples of the group X of general structure II:

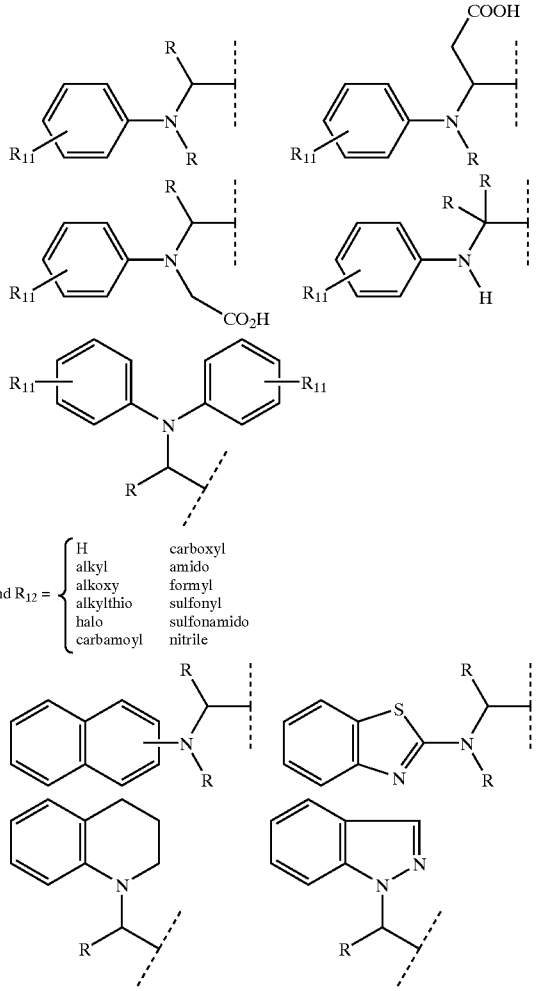

$R_{11}$ and $R_{12}$ = { H, alkyl, alkoxy, alkylthio, halo, carbamoyl, carboxyl, amido, formyl, sulfonyl, sulfonamido, nitrile }

-continued

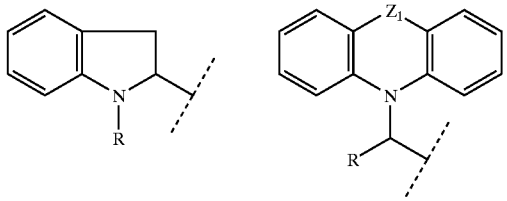

$Z_1$=a covalent bond, S, O, Se, NR, $CR_2$, CR═CR, or $CH_2CH_2$.

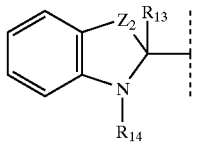

$Z_2$=S, O, Se, NR, $CR_2$, CR═CR, $R_{13}$,=alkyl, substituted alkyl or aryl, and $R_{14}$=H, alkyl substituted alkyl or aryl.

The following are illustrative examples of the group X of the general structure III:

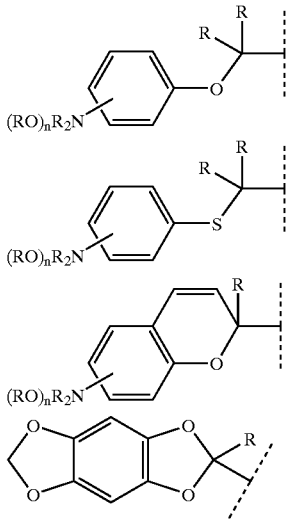

n = 1–3

The following are illustrative examples of the group X of the general structure IV:

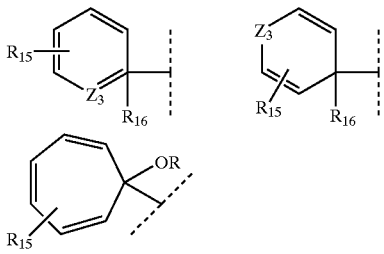

$Z_3$=O, S, Se, NR;

$R_{15}$=R, OR, $NR_2$;

$R_{16}$=alkyl, substituted alkyl.

Preferred Y' groups are:

(1) X', where X' is an X group as defined in structures I–IV and may be the same as or different from the X group to which it is attached (2)

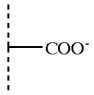

(3)

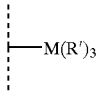

where M=Si, Sn or Ge; and R'=alkyl or substituted alkyl (4)

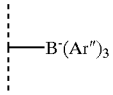

where Ar″ = aryl or substituted aryl (5)

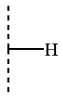

In preferred embodiments of this invention Y' is —H, —COO— or —Si(R')$_3$ or —X'. Particularly preferred Y' groups are —H, —COO— or —Si(R')$_3$.

In embodiments of the invention in which Y' is a proton, a base, β, is covalently linked directly or indirectly to X. The base is preferably the conjugate base of an acid of pKa between about 1 and about 8, preferably about 2 to about 7. Collections of pKa values are available (see, for example: Dissociation Constants of Organic Bases in Aqueous Solution, D. D. Perrin (Butterworths, London, 1965); CRC Handbook of Chemistry and Physics, 77th ed, D. R. Lide (CRC Press, Boca Raton, Fla., 1996)). Examples of useful bases are included in Table I.

TABLE I

| pKa's in water of the conjugate acids of some useful bases | |
|---|---|
| $CH_3$—$CO_2^-$ | 4.76 |
| $C_2H_5$—$CO_2^-$ | 4.87 |
| $(CH_3)_2CH$—$CO_2^-$ | 4.84 |
| $(CH_3)_3C$—$CO_2^-$ | 5.03 |
| HO—$CH_2$—$CO_2^-$ | 3.83 |
| 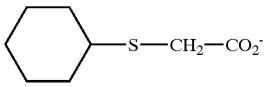 | 3.48 |
| $CH_3$—CO—NH—$CH_2$—$CO_2^-$ | 3.67 |
| 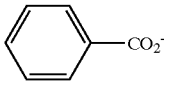 | 4.19 |
| 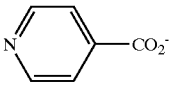 | 4.96 |

TABLE I-continued

| pKa's in water of the conjugate acids of some useful bases | |
|---|---|
| $CH_3—COS^-$ | 3.33 |
| 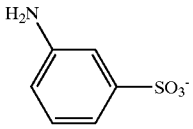 | 3.73 |
| 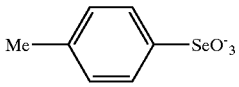 | 4.88 |
| 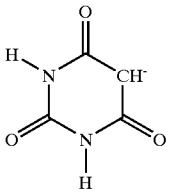 | 4.01 |
| 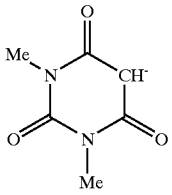 | 4.7 |
| $(CH_3)_3\overset{+}{N}—\overset{-}{O}$ | 4.65 |
| $H_2N—CH_2—CH(CH_3)—\overset{+}{N}H_3$ | 6.61 |
| 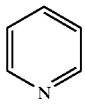 | 5.25 |
| 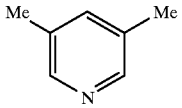 | 6.15 |
| 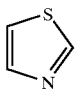 | 2.44 |
| 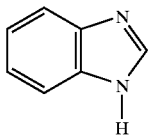 | 5.53 |

Preferably the base, $\beta^-$ is a carboxylate, sulfate or amine oxide.

In some embodiments of the invention, the fragmentable electron donating compound contains a light absorbing group, Z, which is attached directly or indirectly to X, a silver halide absorptive group, A, directly or indirectly attached to X, or a chromophore forming group, Q, which is attached to X. Such fragmentable electron donating compounds are preferably of the following formulae:

$Z—(L—X—Y')_k$ $A—(L—X—Y')_k$ $(A—L)_k—X—Y'$ $Q—X—Y'$ $A—(X—Y')_k$ $(A)_k—X—Y'$ $Z—(X—Y')_k$ or $(Z)_k—X—Y'$

Z is a light absorbing group;

k is 1 or 2;

A is a silver halide adsorptive group that preferably contains at least one atom of N, S, P, Se, or Te that promotes adsorption to silver halide;

L represents a linking group containing at least one C, N, S, P or O atom; and

Q represents the atoms necessary to form a chromophore comprising an amidinium-ion, a carboxyl-ion or dipolar-amidic chromophoric system when conjugated with X—Y'.

Z is a light absorbing group derived from, for example, cyanine dyes, complex cyanine dyes, merocyanine dyes, complex merocyanine dyes, homopolar cyanine dyes, styryl dyes, oxonol dyes, hemioxonol dyes, and hemicyanine dyes.

Preferred Z groups are derived from the following dyes:

Dye 1

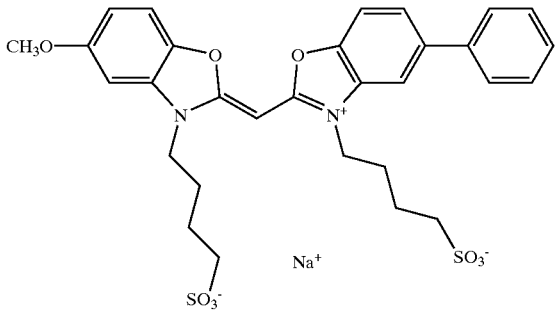

Dye 2

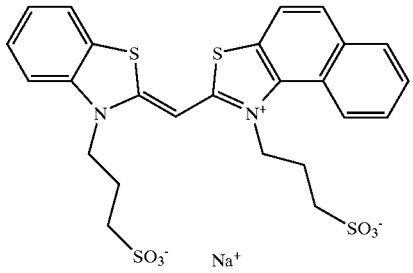

-continued

Dye 3

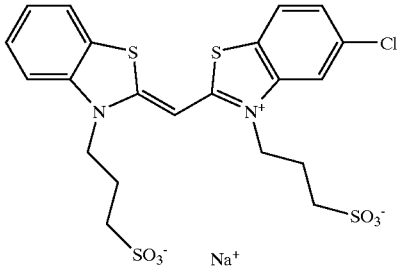

Dye 4

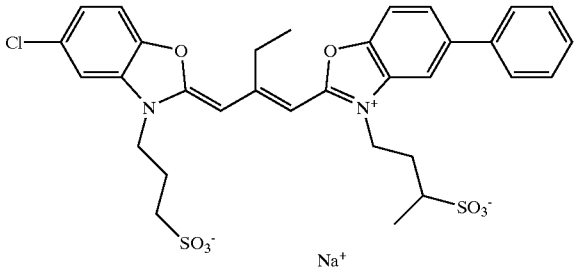

Dye 5

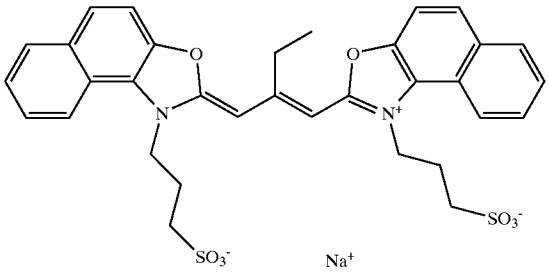

Dye 6

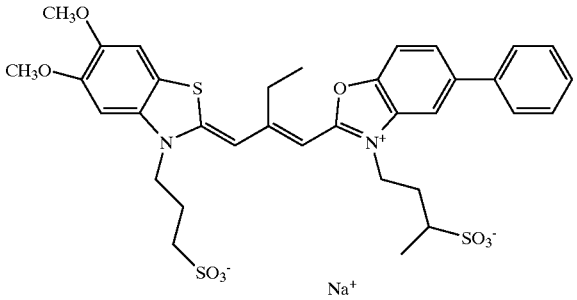

Dye 7

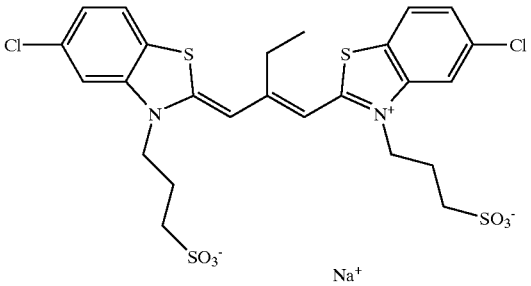

and

-continued

Dye 8

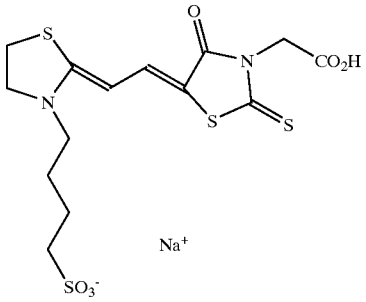

The linking group L may be attached to the dye at one (or more) of the heteroatoms, at one (or more) of the aromatic or heterocyclic rings, or at one (or more) of the atoms of the polymethine chain, at one (or more) of the heteroatoms, at one (or more) of the aromatic or heterocyclic rings, or at one (or more) of the atoms of the polymethine chain. For simplicity, and because of the multiple possible attachment sites, the attachment of the L group is not specifically indicated in the generic structures.

The silver halide adsorptive group A is preferably a silver-ion ligand moiety or a cationic surfactant moiety. In preferred embodiments, A is selected from the group consisting of: i) sulfur acids and their Se and Te analogs, ii) nitrogen acids, iii) thioethers and their Se and Te analogs, iv) phosphines, v) thionamides, selenamides, and telluramides, and vi) carbon acids.

Illustrative A groups include:

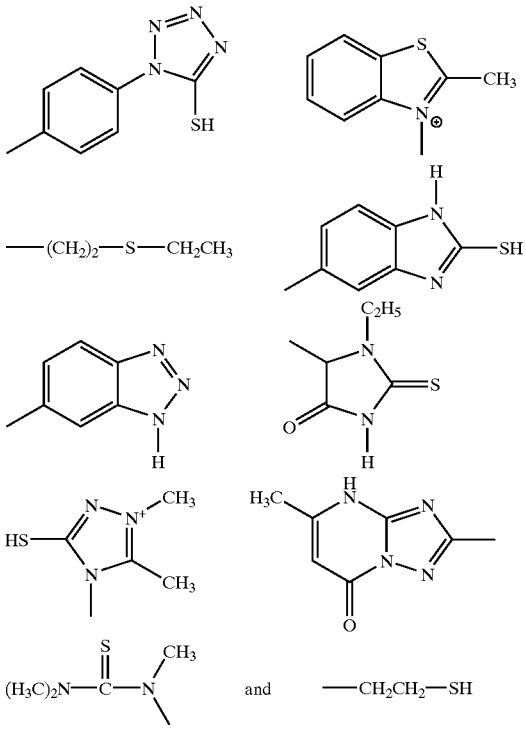

The point of attachment of the linking group L to the silver halide adsorptive group A will vary depending on the structure of the adsorptive group, and may be at one (or more) of the heteroatoms, at one (or more) of the aromatic or heterocyclic rings.

The linkage group represented by L which connects the light absorbing group to the fragmentable electron donating group XY by a covalent bond is preferably an organic linking group containing a least one C, N, S, or O atom. It is also desired that the linking group not be completely aromatic or unsaturated, so that a pi-conjugation system cannot exist between the Z and XY moieties. Preferred examples of the linkage group include, an alkylene group, an arylene group, —O—, —S—, —C═O, —$SO_2$—, —NH—, —P═O, and —N═. Each of these linking components can be optionally substituted and can be used alone or in combination. Examples of preferred combinations of these groups are:

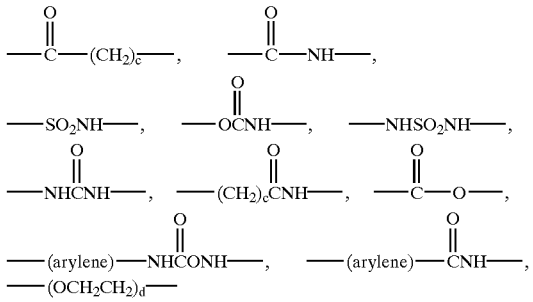

where c=1–30, and d=1–10

The length of the linkage group can be limited to a single atom or can be much longer, for instance up to 30 atoms in length. A preferred length is from about 2 to 20 atoms, and most preferred is 3 to 10 atoms. Some preferred examples of L can be represented by the general formulae indicated below:

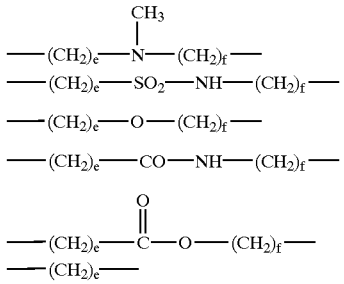

e and f = 1–30, with the proviso that e + f ≤ 30

Q represents the atoms necessary to form a chromophore comprising an amidinium-ion, a carboxyl-ion or dipolar-amidic chromophoric system when conjugated with X—Y'. Preferably the chromophoric system is of the type generally found in cyanine, complex cyanine, hemicyanine, merocyanine, and complex merocyanine dyes as described in F. M. Hamer, *The Cyanine Dyes and Related Compounds* (Interscience Publishers, New York, 1964).

Illustrative Q groups include:

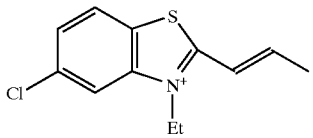

-continued

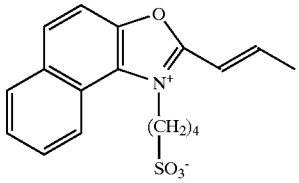

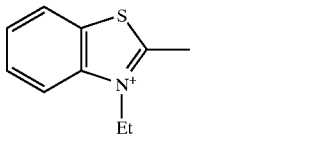

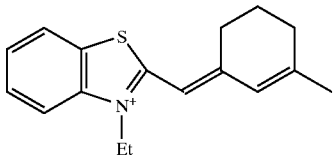

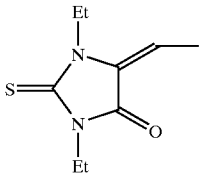

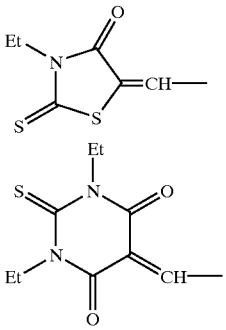

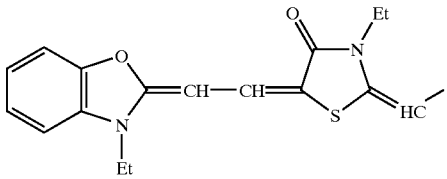

Particularly preferred are Q groups of the formula:

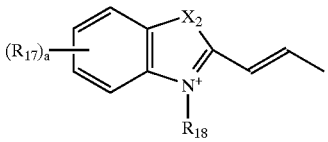

wherein:

$X_2$ is O, S, N, or $C(R_{19})_2$, where $R_{19}$ is substituted or unsubstituted alkyl;

each $R_{17}$ is independently a hydrogen atom, a halogen atom, a substituted or unsubstituted alkyl group, or substituted or unsubstituted aryl group;

a is an integer of 1–4; and $R_{18}$ is substituted or unsubstituted alkyl, or substituted or unsubstituted aryl.

Illustrative fragmentable electron donating compounds include:

FED 1
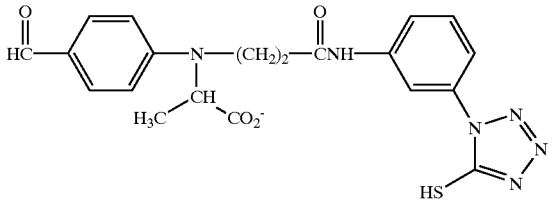
FED 2
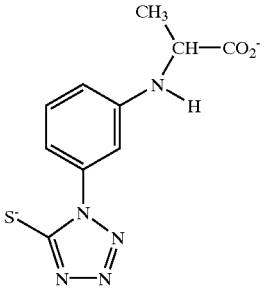
FED 3
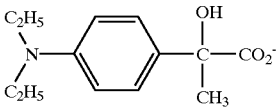
FED 4
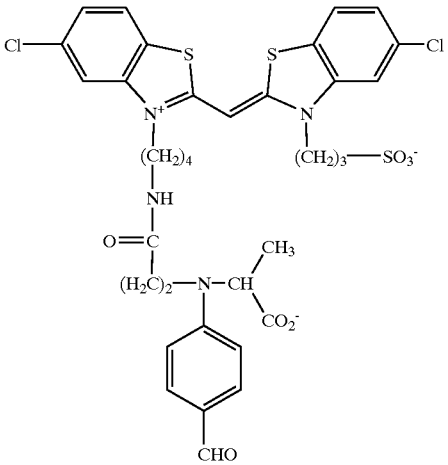
FED 5
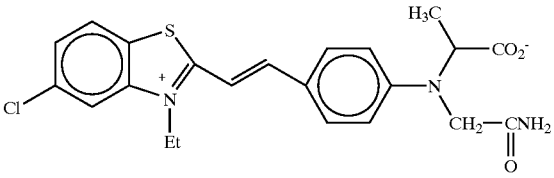
FED 6
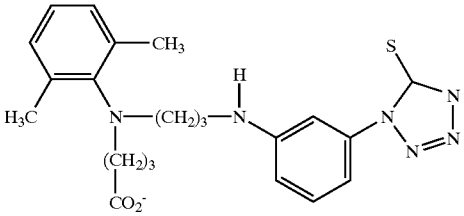
-continued
FED 7
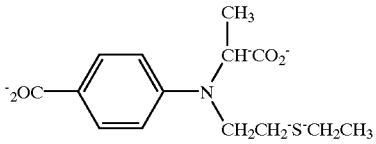
FED 8
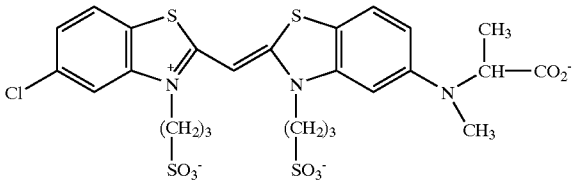
FED 9
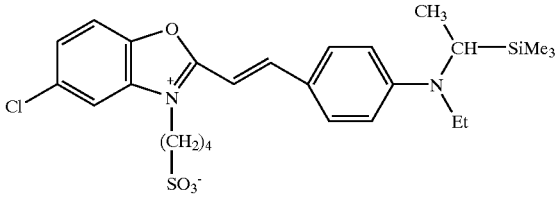
FED 10
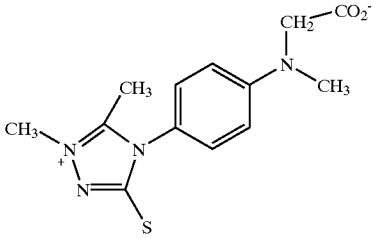
FED 11
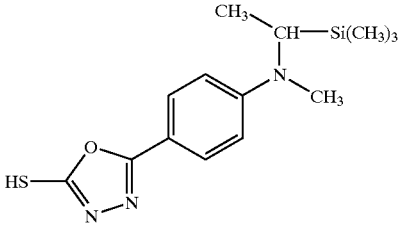
FED 12
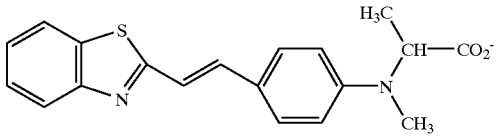
FED 13
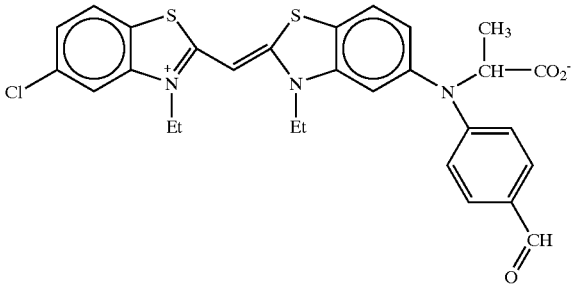

-continued

FED 14

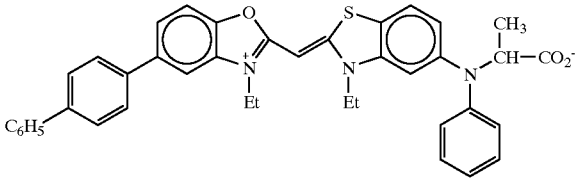

FED 15

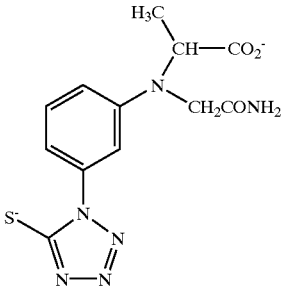

FED 16

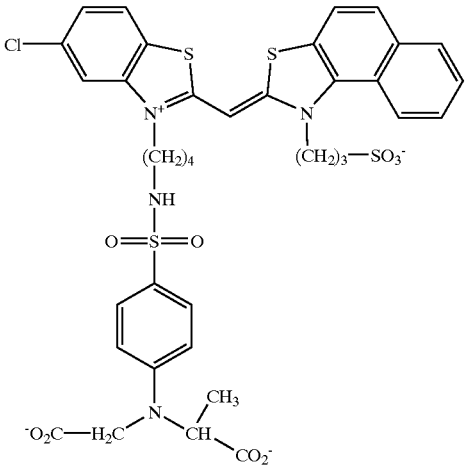

FED 17

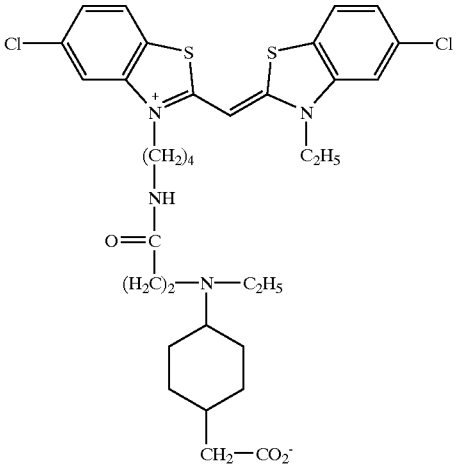

FED 18

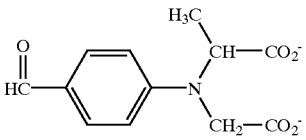

-continued

FED 18

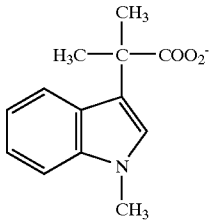

FED 20

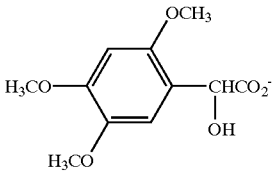

FED 21

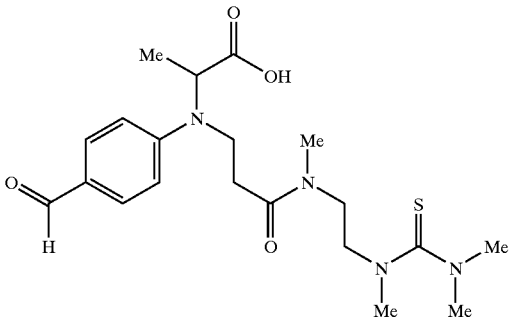

FED 22

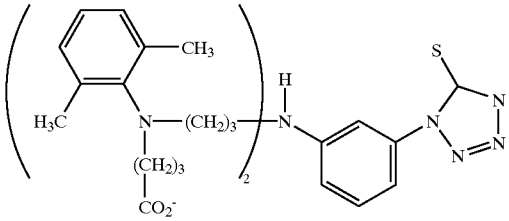

Fragmentable electron donating compounds are described more fully in U.S. Pat. Nos. 5,747,235 and 5,747,236 and commonly assigned co-pending U.S. applications Ser. No. 08/739,911 filed Oct. 30, 1996, and Ser. Nos. 09/118,536, 09/118,552 and 09/118,714 filed Jul. 25, 1998, the entire disclosures of these patents and patent applications are incorporated herein by reference.

The photographic element has a blue sensitive emulsion with broad blue spectral coverage and enhanced speed. The element comprises a silver halide emulsion sensitized with a dye of formula (VI) and a dye of formula (VII), wherein the formula (VI) dye on the emulsion has a peak sensitization between 400–445 nm and the formula (VII) dye on the emulsion has a peak sensitization between 446–500 nm.

(VI)

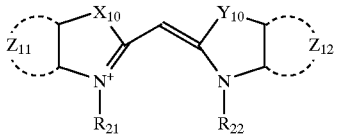

-continued

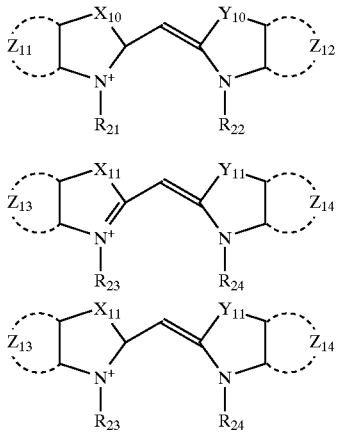

(VII)

wherein:

$Z_{11}$, $Z_{12}$, $Z_{13}$, and $Z_{14}$ independently represent the atoms necessary to complete a substituted or unsubstituted benzene or naphthylene;

$X_{10}$, $Y_{10}$, $X_{11}$ and $Y_{11}$ are independently O, S, Se or $NR_{25}$, provided that at least $X_{10}$ or $Y_{10}$ is O or $NR_{25}$, wherein $R_{25}$ is an alkyl, alkenyl or aryl (preferably alkyl or aryl), any of which may be substituted or unsubstituted;

$R_{21}$, $R_{22}$, $R_{23}$ and $R_{24}$ independently represent an alkyl, alkenyl or aryl group (preferably alkyl or aryl), any or which may be substituted or unsubstituted.

In the above and throughout this application, it will be understood that reference to a substituted or unsubstituted benzene ring does not include a benzene ring with other annellated aromatic rings. Thus, a substituted or unsubstituted benzene ring does not include naphthylene or higher fused ring systems. Similarly, reference to substituted or unsubstituted naphthylene does not include anthracene or higher fused ring systems.

In the formula (VI) and (VII), $R_{21}$, $R_{22}$, $R_{23}$ and $R_{24}$ may particularly be a substituted or unsubstituted lower alkyl (that is, from 1 to 6 carbon atoms), or may preferably be a substituted or unsubstituted 1 to 4 carbon atom alkyl. The dye of formula (VI) may particularly be selected to provide a peak sensitivity, on the emulsion, of between 436 to 444 nm (or even 430–440 nm or 433–437 nm).

The dye of formula (VI) may be a dye of formula (VIa) or (VIb):

(VIa)

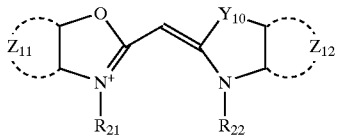

(VIb)

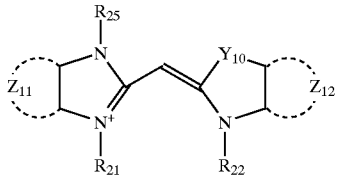

Preferably, at least one of $Z_{11}$ or $Z_{12}$ form a benzene ring. Dyes of formulae VI and VII may particularly have at least one acid or acid salt group, such as a carboxy, sulfonamido, sulfamoyl, sulfato or sulfo substituent. This may particularly be on $R_{21}$, $R_{22}$, $R_{23}$ and/or $R_{24}$, and even more particularly $R_{21}$, $R_{22}$, $R_{23}$ and/or $R_{24}$ may be an alkyl group substituted with such an acid or acid salt group ($R_{21}$, $R_{22}$, $R_{23}$ and/or $R_{24}$ may particularly be a sulfoalkyl group, such as sulfomethyl, sulfoethyl, sulfopropyl, of sulfobutyl).

Any of the alkyl groups described above include cycloalkyl. Examples of any of the alkyl groups mentioned above are methyl, ethyl, propyl, isopropyl, butyl, isobutyl, t-butyl, pentyl, hexyl, octyl, 2-ethylhexyl, and the like. Particular cycloalkyl groups can be cyclopentyl, cyclohexyl, 4-methylcyclohexyl, and the like. Alkenyl groups can be vinyl, 1-propenyl, 1-butenyl, 2-butenyl, and the like. Aryl groups can be phenyl, naphthyl, styryl, and the like. Aralkyl groups (which are a type of substituted alkyl) can be benzyl, phenethyl, and the like. Useful substituents on any of the foregoing or other groups disclosed (including substituents on $Z_{13}$ and $Z_{14}$), include halogen., alkyl (particularly lower alkyl), alkoxy, acyl, alkoxycarbonyl, aminocarbonyl, carbonamido, carboxy, sulfamoyl, sulfonamido, sulfo, nitro, hydroxy, amino, cyano, trifluoromethyl and the like. Any of the foregoing (where possible) may be substituted or unsubstituted.

As to the particular tabular grain emulsion, this may be any suitable silver halide (including silver chloride, silver bromide, and the like) but in particular may be silver bromoiodide. The iodide levels therein can vary but preferably the emulsion has less than 8% iodide ( or even, less than 6% or 4% iodide) It will be appreciated in the present application that when a percentage level of a specific halide is referred to, this is the mole percentage of all halides in the silver halide represented by the specific halide (for example, 2% iodide means that of all halide present, 2 mole % is iodide). The blue sensitive silver halide tabular grain emulsion is typically not sensitized with any dye which provides a maximum sensitivity on the emulsion of 500 nm or greater. In addition to tabular emulsions of the various halide compositions described above, emulsions with three dimensional morphology (ie cubic, octahedral, polymorphic, and the like) may also be used, provided that the silver halide of the emulsion has at least 50% chloride and less than 5% iodide.

A color photographic element of the present invention may have a red sensitive silver halide emulsion layer containing a coupler which produces a cyan dye upon reaction with oxidized developer, a green sensitive silver halide emulsion layer containing a coupler which produces a magenta dye upon reaction with oxidized developer, and a blue sensitive silver halide emulsion layer containing a coupler which produces a yellow dye upon reaction with oxidized developer. The blue sensitive silver layer may be of the above described tabular type sensitized with a dye of formula (VI) and a dye of formula (VII), as already described, such that the sensitized emulsion meets the limitations as defined in U.S. Pat. No. 5,460,928, the entire disclosure of which is incorporated herein by reference. Alternatively, such blue sensitized tabular grain emulsion may be sensitized with dyes of formula VI or VII so as to meet the sensitivity limitations defined in U.S. Pat. No. 5,576,157, the entire disclosure of which is incorporated herein by reference. The foregoing applications and any other references cited herein are incorporated in this application by reference.

For example, the blue sensitive tabular emulsion layer may be sensitized with dyes of formula (VI) and (VII) in accordance with U.S. Pat. No. 5,576,157, such that the wavelength of maximum sensitivity of the emulsion between 400–500 nm ("$\lambda_{Bmax}$"), the sensitivity at 485 nm ("$S_{485}$"), the sensitivity at 410 nm ("$S_{410}$"), and the sensitivity at $\lambda_{Bmax}$ ("$S_{Bmax}$"), are defined by:

$$430\ \text{nm}=\lambda_{Bmax}=440\ \text{nm or } 450\ \text{nm}=\lambda_{Bmax}=480\ \text{nm}$$

and:

$$S_{485}=50\%\ (S_{Bmax})$$

$$S_{410}=60\%\ (S_{Bmax})$$

and the maximum sensitivity of the emulsion between 430–440 nm ("$S_{(430\text{-}440)max}$"), and the maximum sensitivity between 450–480 nm ("$S_{(450\text{-}480)max}$"), have the following relationship:

$$90\%\ (S_{450\text{-}480)max})=S_{(430\text{-}440)max}=110\%\ (S_{(450\text{-}480)max}).$$

As to the amounts of dyes of formula (VI) and (VII) that would be used, the total amount of both dyes together would typically be between 0.1 to 5 millimoles of dye per mole of silver halide (mmoles/mole). Preferably, the total amount would be between 0.5 mmoles/mole to 3 mmoles/mole. As to the molar ratios of dyes (VI) to (VII), the ratio of (VI):(VII) would typically be between 1:4 to 4:1 and or even between 1:3 to 2:1.

Illustrative dyes of formula (VI) include, for

VI-1

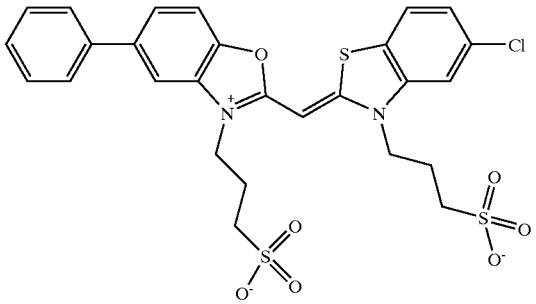

VI-2

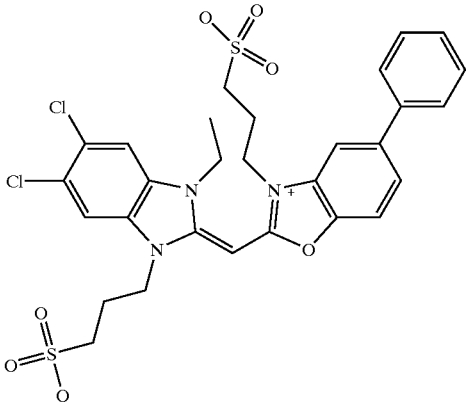

-continued

VI-3

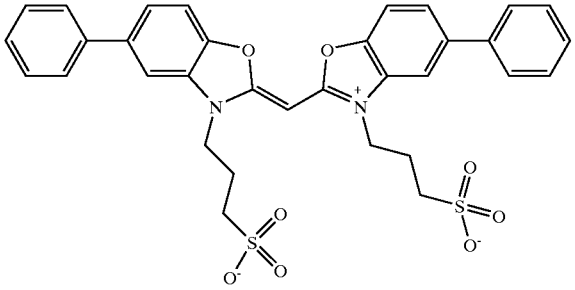

VI-4

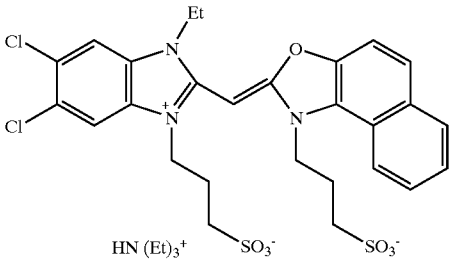

VI-5

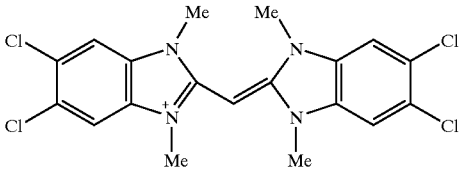

pts

VI-6

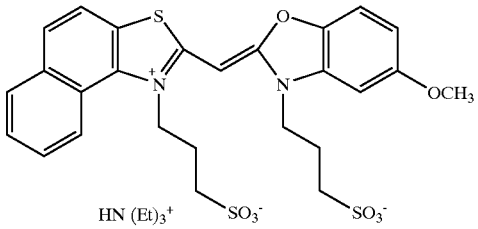

VI-7

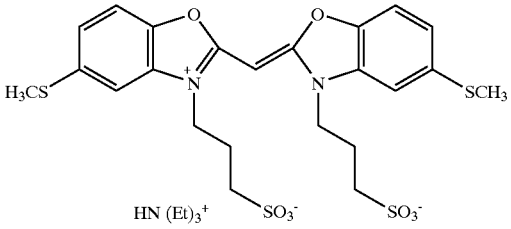

Illustrative dyes of formula (VII) include, for

VII-1

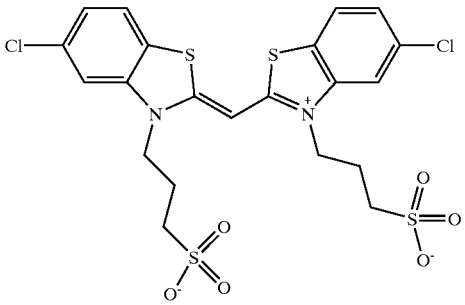

-continued
VII-2
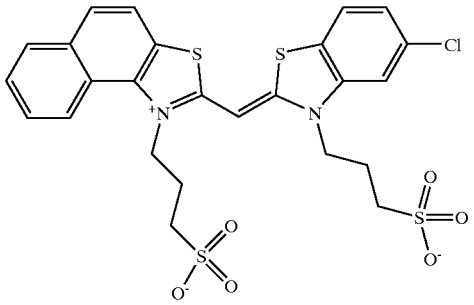
VII-3
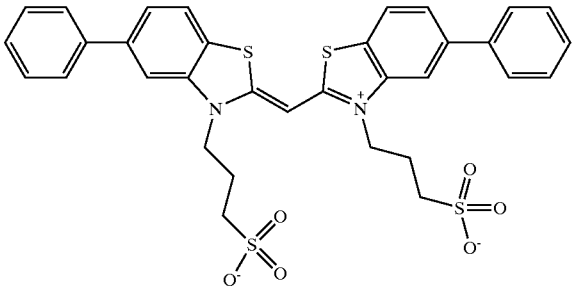
VII-4
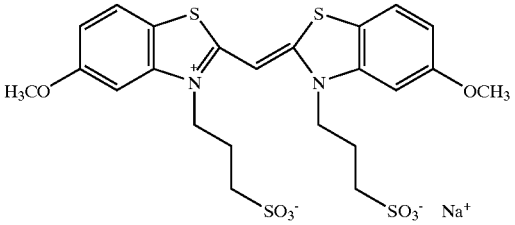
VII-5
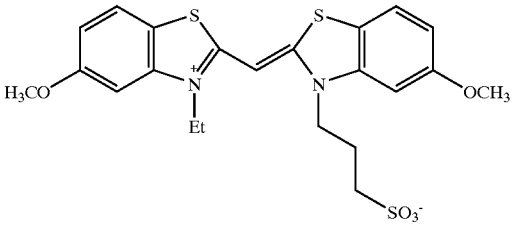
VII-6
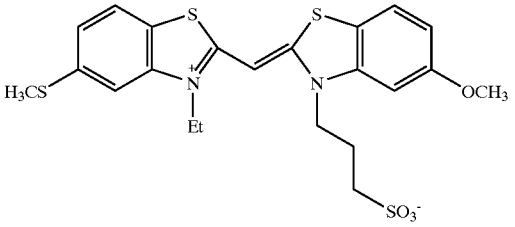
VII-7
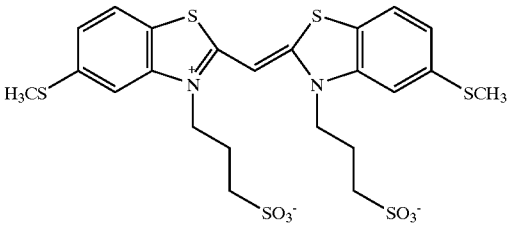
-continued
VII-8
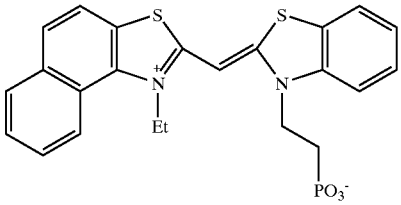
VII-9
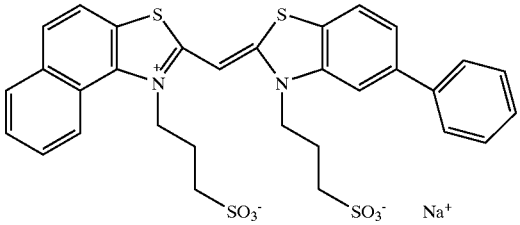
VII-10
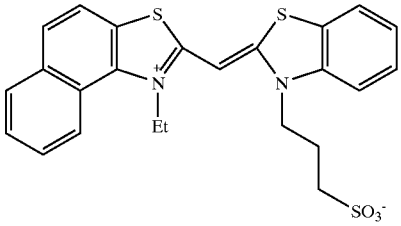
VII-11
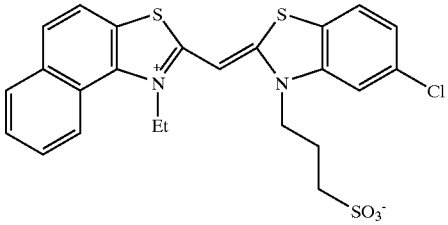
VII-12
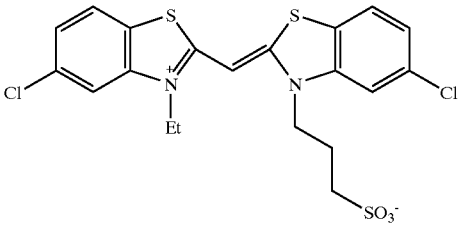
VII-13
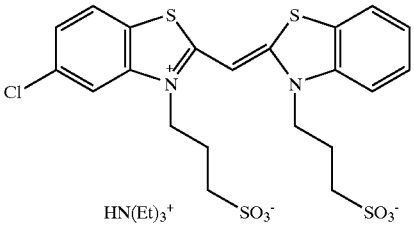

-continued

VII-14

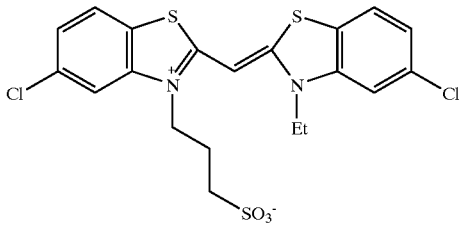

The emulsion layer of the photographic element of the invention can comprise any one or more of the light sensitive layers of the photographic element. The photographic elements made in accordance with the present invention can be black and white elements, single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support).

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure*, September 1996, Number 389, Item 38957, which will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated herein by reference.

The silver halide emulsions employed in the photographic elements of the present invention may be negative-working, such as surface-sensitive emulsions or unfogged internal latent image forming emulsions, or positive working emulsions of the internal latent image forming type (that are fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); development inhibitors and their precursors (U.S. Pat. No. 5,460,932; U.S. Pat. No. 5,478,711); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

As discussed above, tabular grain silver halide emulsions may also be used in the practice of this invention. Tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t>8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$)>25 and ECD and t are both measured in micrometers (?m). The tabular grains can be of any thickness compatible with achieving an aim average aspect ratio and/or average tabularity of the tabular grain emulsion. Preferably the tabular grains satisfying projected area requirements are those having thicknesses of <0.3 $\mu$m, thin (<0.2 $\mu$m) tabular grains being specifically preferred and ultrathin (<0.07 $\mu$m) tabular grains being contemplated for maximum tabular grain performance enhancements.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in *Research Disclosure I*, Section I.B.(3) (page 503).

The silver halide grains to be used in the invention may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure*, Item 36544, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in Research Discolosure Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure. To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

Although generally preferred concentration ranges for the various SET and non-SET Ir dopants have been set out above, it is recognized that specific optimum concentration ranges within these general ranges can be identified for specific applications by routine testing. It is specifically contemplated to employ the SETand non-SET Ir dopants singly or in combination. For example, grains containing a combination of an SET dopant and a non-SET Ir dopant are specifically contemplated.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions.

The silver halide to be used in the invention may be advantageously subjected to chemical sensitization. Compounds and techniques useful for chemical sensitization of silver halide are known in the art and described in *Research Disclosure I* and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as described in *Research Disclosure I*, Section IV (pages 510–511) and the references cited therein.

The sensitization of the silver halide with the dyes of formula VI and VII may be carried out by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I*, or in T. H. James, editor, *The Theory of the Photographic Process*, 4th Edition, Macmillan, New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines.

Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, Research Disclosure, Vol. 116, December, 1973, Item 11660, and Bissonette Research Disclosure, Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development is followed by bleach-fixing, to remove silver or silver halide, washing and drying.

The fragmentable electron donating sensitizer compounds of the present invention can be included in a silver halide emulsion by direct dispersion in the emulsion, or they may be dissolved in a solvent such as water, methanol or ethanol for example, or in a mixture of such solvents, and the resulting solution can be added to the emulsion. The compounds of the present invention may also be added from solutions containing a base and/or surfactants, or may be incorporated into aqueous slurries or gelatin dispersions and then added to the emulsion.

The amount of fragmentable electron donating compound which is employed in this invention may range from as little as $1\times10^{-8}$ mole to as much as about 0.1 mole per mole of silver in an emulsion layer, preferably from as little as $5\times10^{-7}$ mole to as much as about 0.01 mole per mole of silver in an emulsion layer. Where the oxidation potential $E_1$ for the XY moiety of the electron donating sensitizer is a relatively low potential, it is more active, and relatively less agent need be employed. Conversely, where the oxidation potential for the XY moiety of the electron donating sensitizer is relatively high, a larger amount thereof, per mole of silver, is employed. In addition, for XY moieties that have silver halide adsorptive groups A or light absorptive groups Z or chromophoric groups Q directly or indirectly attached to X, the fragmentable electron donating sensitizer is more closely associated with the silver halide grain and relatively less agent need be employed.

Various compounds may be added to the photographic material of the present invention for the purpose of lowering the fogging of the material during manufacture, storage, or processing. Typical antifoggants are discussed in Section VI of Research Disclosure I, for example tetraazaindenes, mercaptotetrazoles, polyhydroxybenzenes, hydroxyaminobenzenes, combinations of a thiosulfonate and a sulfinate, and the like.

For this invention, polyhydroxybenzene and hydroxyaminobenzene compounds (hereinafter "hydroxybenzene compounds") are preferred as they are effective for lowering fog without decreasing the emulsion sensitvity. Examples of hydroxybenzene compounds are:

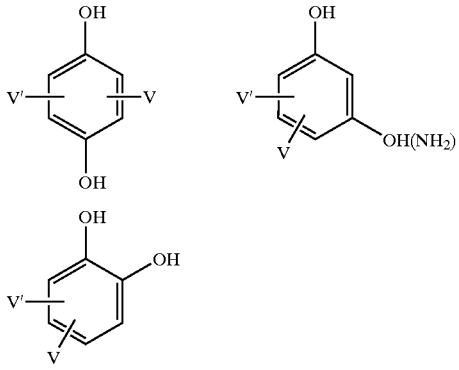

In these formulae, V and V' each independently represent —H, —OH, a halogen atom, —OM (M is alkali metal ion), an alkyl group, a phenyl group, an amino group, a carbonyl group, a sulfone group, a sulfonated phenyl group, a sulfonated alkyl group, a sulfonated amino group, a carboxyphenyl group, a carboxyalkyl group, a carboxyamino group, a hydroxyphenyl group, a hydroxyalkyl group, an alkylether group, an alkylphenyl group, an alkylthioether group, or a phenylthioether group.

More preferably, they each independently represent —H, —OH, —Cl, —Br, —COOH, —$CH_2CH_2COOH$, —$CH_3$, —$CH_2CH_3$, —$C(CH_3)_3$, —$OCH_3$, —CHO, —$SO_3K$, —$SO_3Na$, —$SO_3H$, —$SCH_3$, or -phenyl.

Especially preferred hydroxybenzene compounds follow:

HB1

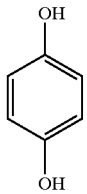

HB2

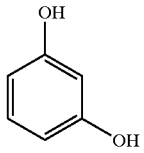

-continued

HB3

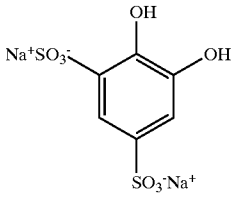

HB4

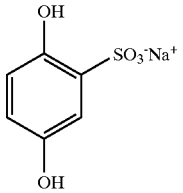

HB5

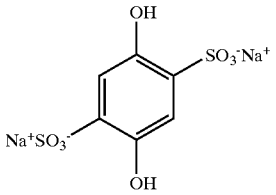

HB6

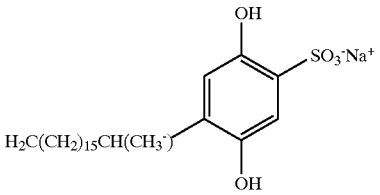

HB7

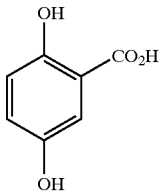

HB8

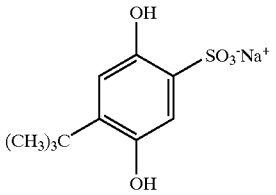

HB9

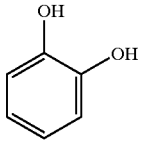

HB10

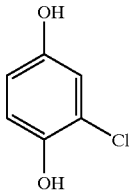

-continued

HB11

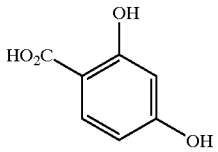

HB12

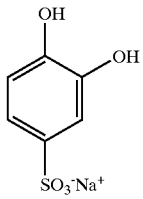

HB13

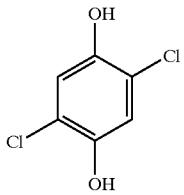

HB14

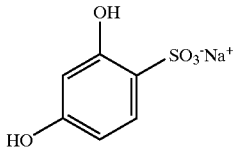

HB15

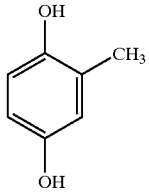

Hydroxybenzene compounds may be added to the emulsion layers or any other layers constituting the photographic material of the present invention. The preferred amount added is from $1\times10^{-3}$ to $1\times10^{-1}$ mol, and more preferred is $1\times10^{-3}$ to $2\times10^{-2}$ mol, per mol of silver halide.

The following examples illustrate the preparation and evaluation of photographic elements of the invention.

EXAMPLE 1

An AgBrI tabular silver halide emulsion (Emulsion E-1) was prepared containing 3.7% total iodide distributed such that the central portion of the emulsion grains contained 1.0% I and the perimeter area contained substantially higher iodide as described by Chang et. al., U.S. Pat. No. 5,314,793. The emulsion grains had an average thickness of 0.136 $\mu$m and average circular diameter of 6.4 $\mu$m. Emulsion E-1 was precipitated using oxidized gelatin and contained additionally 50 molar parts per million of $K_4Ru(CN)_6$ placed at 68% into the precipitation and 0.50 molar parts per million of KSeCN introduced at 71% of the precipitation.

The emulsion was optimally chemically and spectrally sensitized by adding the antifoggant HB3 at a concentration of $1.71\times10^{-3}$ mole/mole Ag, NaSCN, $0.694\times10^{-3}$ mole/mole Ag of the blue sensitizing dye VII-1, or the combination broad blue dye set VII-1 and VI-1 in equal molar quantities, carboxymethyl-trimethyl-2-thiourea, bis(1,4,5-trimethyl-1,2,4-triazolium-3-thiolate) gold(I) tetrafluoroborate, and a benzothiazolium finish modifier and then subjecting the emulsion to a heat cycle to 60° C. For some experimental variations, the electron donating sensitizing agent, FED-2, was added to the emulsion after the heat cycle at $2.6\times10^{-6}$ moles/Ag mole. Coatings were then prepared consisting of sensitized silver halide emulsion at a laydown of 100 mg/ft$^2$, (1.1 g/m$^2$), 150 mg/ft$^2$ (1.65 g/m$^2$) of the yellow dye forming coupler YY-1, and a gelatin vehicle at 300 mg/ft$^2$ (3.3 g/m$^2$). The antifoggant and stabilizer tetraazaindene at a concentration of 1.75 gm/mole Ag was added to the coating melt just prior to coating. An overcoat of gelatin at 80 mg/ft$^2$ (0.88g/m$^2$) was subsequently applied containing a bisvinylsulfonylmethyl ether as a gelatin hardening agent.

For photographic evaluation, each of the coating strips was exposed for 0.01 sec to a 3000° K. color temperature tungsten lamp filtered to give an effective color temperature of 5500° K. and further filtered through both a 0.3 density inconel filter and a Kodak Wratten filter number 2B and a step wedge ranging in density from 0 to 4 density units in 0.2 density steps. This filter passes only light of wavelengths longer than 400 nm, thus giving light absorbed mainly by the sensitizing dye. The exposed film strips were processed in Eastman Kodak C-41 developer. Speed was metered at the intersection of the tangents to the straight line portion of the H & D curve and the asymptotic Dmin region.

The data in Table I represent the sensitivity for the single blue dyed emulsion, the broad blue dyed emulsion and the latter emulsion to which has been added the fragmentable electron donor compound, FED-2. This latter compound has afforded about one half stop, 0.19 log E, of additional speed.

TABLE I

| | | Dmin/Speed/Gamma for emulsion E-1 | | | | | |
|---|---|---|---|---|---|---|---|
| | | | | Photographic Sensitivity | | | |
| Test | Dye | FED | | | Relative | | Re- |
| No. | Set | ID | Level | Dmin | Speed | Gamma | marks |
| 1 | VII-1 | None | — | 0.13 | 100 | 0.91 | Comp. |
| 2 | VII-1 + VI-1 | None | — | 0.09 | 65 | 0.75 | Comp. |
| 3 | VII-1 + VI-1 | FED-2 | 0.8 mg | 0.13 | 100 | 0.96 | In-vention |

The optical absorption spectra for the two differently dyed emulsions is presented in FIG. 1., where the diminished long wavelength 470 nm peak intensity in the presence of the shorter wavelength 440 nm absorbing dye is clearly evident. The difference in log integrated light absorption between the single dyed emulsion, 2.763 log units, and the broad blue dyed emulsion, 2.576 log units, is 0.187. Thus this optical absorption deficit has been exactly compensated by the increase in dyed speed due to the fragmentable electron donor compound.

EXAMPLE 2

An AgBrI tabular silver halide emulsion (Emulsion E-2) was prepared containing 2% total iodide distributed such that the central portion of the emulsion grains contained no iodide and the perimeter area contained substantially higher iodide as described by Chang et. al., U.S. Pat. No. 5,314,793. The emulsion grains had an average thickness of 0.13 $\mu$m and average circular diameter of 5.0 $\mu$m. The emulsion was precipitated using deionized gelatin and contained 0.53 molar parts per million of KSeCN per silver mole introduced at 80% of the precipitation. The emulsion was optimally chemically and spectrally sensitized by adding NaSCN, $7.26\times10^{-4}$ mole/mole Ag of the blue sensitizing dye VI-1 or $3.49\times10^{-4}$ mole/mole silver each of VII-1 and VI-1, a mercaptotetrazole antifogging agent, $Na_3Au(S_2O_3)_2.2H_2O$, $Na_2S_2O_3.5H_2O$ and a benzothiazolium finish modifier. The emulsion was then subjected to a heat cycle to 60° C. The antifoggant-stabilizer, tetraazaindene, at a concentration of $1.02\times10^{-2}$ mole/mole silver, was added to the emulsion melt after the chemical sensitization procedure. For emulsions sensitized with the combination of dyes VII-1 and VI-1, another variant included adding the antifoggant, HB3, at a concentration of $1.29\times10^{-2}$ mole/mole silver followed by a fragmentable electron donor (FED) subsequent to the tetraazaindene.

Coatings were then prepared as follows. The experimental emulsions were coated in a model yellow single layer format: emulsion coat of 90 mg/ft$^2$ (0.99 g/m$^2$) silver, 70 mg/ft$^2$ (0.77 g/m$^2$) of yellow image coupler YY-2 and 250 mg/ft$^2$ (2.75 g/m$^2$) gelatin; overcoat containing 100 mg/ft$^2$ (1.1 g/m$^2$) gelatin and 1.75% (by weight to coated gel) bis(vinylsulfonyl)methane hardener.

Testing was carried out to determine the response of the coatings to a spectral exposure. The dyed coating strips were exposed for 0.01 sec to a 3000° K. color temperature tungsten lamp filtered to give an effective color temperature of 5500° K. and further filtered through a Kodak Wratten filter number 2B and a step wedge ranging in density from 0 to 4 density units in 0.2 density steps. This filter passes only light of wavelengths longer than 400 nm, thus giving light absorbed mainly by the sensitizing dye. The exposed film strips were developed for 3 minutes and 15 seconds in Eastman Kodak C-41 color negative process. Photographic sensitivity for this Kodak Wratten filter 2B exposure was metered at the intersection of the tangents to the straight line portion of the H & D curve and the asymptotic Dmin region. The data in Table II represent the sensivity for the single blue dyed emulsion, the broad blue dyed emulsion and the latter emulsion to which has been added FED compounds at various levels.

TABLE II

Dmin/Speed/Gamma for Emulsion E-2 with and without various ED compounds.

| Test | Dye | FED | | Photographic Sensitivity | | | |
|---|---|---|---|---|---|---|---|
| | | | | Relative | | | Re- |
| No. | Set | ID | Level | Dmin | Speed | Gamma | marks |
| 1 | VII-I | None | — | 0.117 | 100 | 1.09 | Comp. |
| 2 | VII-1 + VI-1 | None | — | 0.082 | 60 | 1.07 | Comp. |
| 3 | VII-1 + VI-1 | FED-2 | 0.3 mg | 0.119 | 87 | 1.00 | Invention |
| 4 | " | " | 0.6 mg | 0.156 | 98 | 0.94 | " |
| 5 | " | FED-1 | 1.2 mg | 0.090 | 85 | 1.03 | " |
| 6 | " | " | 2.4 mg | 0.119 | 91 | 0.96 | " |
| 7 | " | FED-3 | 28.5 mg | 0.090 | 79 | 1.03 | " |
| 8 | " | " | 57.0 mg | 0.148 | 76 | 0.99 | " |
| 9 | " | " | 114 mg | 0.102 | 89 | 1.00 | " |
| 10 | " | FED-4 | 2.0 mg | 0.086 | 78 | 1.03 | " |
| 11 | " | " | 4.0 mg | 0.093 | 81 | 1.03 | " |
| 12 | " | " | 8.0 mg | 0.109 | 83 | 1.03 | " |
| 13 | " | FED-5 | 0.55 mg | 0.118 | 72 | 1.03 | " |
| 14 | " | " | 1.10 mg | 0.102 | 74 | 1.04 | " |
| 15 | " | " | 2.20 mg | 0.105 | 81 | 1.02 | " |
| 16 | " | FED-6 | 0.40 mg | 0.121 | 78 | 1.02 | " |
| 17 | " | " | 0.80 mg | 0.141 | 81 | 1.02 | " |
| 18 | " | " | 1.60 mg | 0.190 | 79 | 1.00 | " |
| 19 | " | FED-7 | 17 mg | 0.096 | 85 | 1.02 | " |
| 20 | " | " | 34 mg | 0.116 | 69 | 1.27 | " |
| | " | " | 68 mg | 0.101 | 89 | 1.04 | " |

The VII-1+VI-1 dye combination clearly reduces photographic sensitivity, however, the lost sensitivity is recovered through addition of a fragmentable electron donor compound or a deprotonating electron donor compound.

EXAMPLE 3

An AgBrI tabular silver halide emulsion E-3 was prepared containing 4.05% total I distributed such that the central portion of the emulsion grains contained 1.5% I and the perimeter area contained substantially higher I, as described by Chang et. al., U.S. Pat. No. 5,314,793. The emulsion grains had an average thickness of 0.105 $\mu$m and an average circular diameter of 1.18 $\mu$m. The emulsion was optimally chemically and spectrally sensitized by adding NaSCN, carboxymethyl-trimethyl-2-thiourea, bis(1,4,5-trimethyl-1,2,4-triazolium-3-thiolate) gold(I) tetrafluoroborate, and a benzothiazolium finish modifier and then subjecting the emulsion to a heat cycle to 65° C. The emulsion was then dyed with a single long blue dye or a combination of long and short blue dyes as detailed in Table III below. The total concentration of blue dye added was always $1.0\times10^{-3}$ mol/mol Ag: for the combinations of long blue dye and one short blue dye, the molar ratio of dyes was 1:1; for the combination of long blue dye and two short blue dyes, the molar ratio of dyes was 1:0.5:0.5. The HB3 at $13\times10^{-3}$ mol/mol Ag and tetraazaindene at 1.75 g/mol Ag were added to the emulsion melt after the dyeing procedure. The fragmentable electron donor FED-1 was then added to selected dyed emulsions, as indicated in Table III.

The melts were prepared for coating by adding additional water, and gelatin. Coatings were prepared by combining the emulsion melts with a melt containing gelatin, coating surfactants, additional HB3, and an aqueous dispersion of the yellow-forming color couplers YY-2 and YY-3 and coating the resulting mixture on acetate support. The final coatings contained Ag at 80 mg/ft$^2$ (0.88 g/m$^2$), YY-1 coupler at 100 mg/ft$^2$ (1.1 g/m$^2$), YY-3 coupler at 3 mg/ft$^2$ (0.03 g/m$^2$), and gelatin at 300 mg/ft$^2$ (3.3 g/m$^2$). The coatings were overcoated with a protective layer containing gelatin at 200 mg/ft$^2$ (2.2 g/m$^2$), coating surfactants, and a bisvinylsulfonylmethyl ether as a gelatin hardening agent.

For photographic evaluation, each of the coating strips was exposed for 0.01 sec to a 3000° K. color temperature tungsten lamp filtered to give an effective color temperature of 5500° K. and further filtered through a Kodak Wratten filter number 2B, and a step wedge ranging in density from 0 to 4 density units in 0.20 density steps. This exposure gives light absorbed mainly by the sensitizing dyes. The exposed film strips were developed for 3¼ minutes in Eastman Kodak C-41 color developer. $S_{WR2B}$, relative speed for the Kodak Wratten 2B filtered exposure was evaluated at the intersection of tangents to the straight line portion of the H&D curve and the asymptotic Dmin region. Relative sensitivity was set equal to 100 for each of the coatings containing only a long blue dye.

The data in Table III show that combination of a short blue dye with any of the long blue dyes VII-1 through VII-3 results in a speed loss for this WR2B exposure compared to the long blue dye alone. The 3 dye combination of VII-2 with VI-1 plus VI-3 also gives a speed loss relative to VII-2 alone. Addition of the fragmentable electron donating sensitizer FED-1 to the dye combinations restores this lost speed and in many cases, gives speed that is somewhat greater than the long blue dye alone. Consequently, the data in Table III shows that the fragmentable electron donating sensitizers can be used with a number of different broad blue dye combinations to give an overall blue speed position which is at least as good as the speed of single long blue dyes alone. In this way, the requirements of both speed and color reproduction can be met.

YY-1

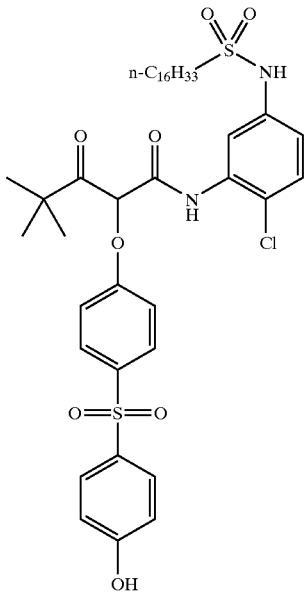

YY-2

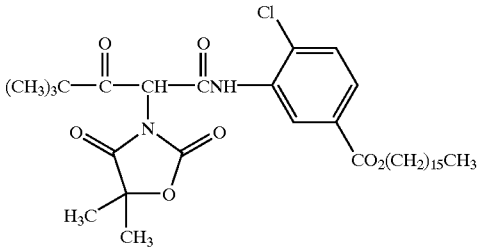

YY-3

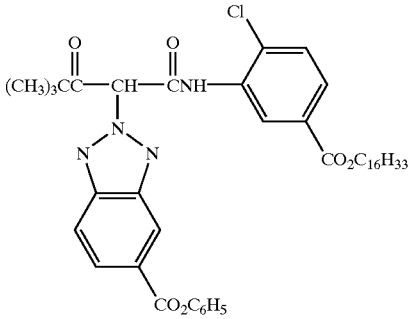

TABLE III

Speed and Dmin for FED Compounds with Various Broad Blue Dye Combinations

| Long Dye (Dye VII) | Peak Abs provided by Dye VII (nm) | Short Dye A (Dye VIA) | Peak Abs provided by Dye VIA (nm) | Short Dye B (Dye VIB) | Peak Abs provided by Dye VIB (nm) | Conc of FED (mol/mol Ag) | Photographic Sensitivity $S_{WR2B}$ | Dmin | Gamma |
|---|---|---|---|---|---|---|---|---|---|
| VII-1 | 471 | — | | | | | 100 | 0.08 | 1.63 |
| " | 471 | VI-1 | 440 | | | | 87 | 0.09 | 1.58 |
| " | 470 | VI-2 | 425 | | | | 81 | 0.08 | 1.67 |
| " | 470 | VI-3 | 414 | | | | 72 | 0.08 | 1.63 |
| " | 471 | VI-1 | 440 | | | $2.3 \times 10^{-5}$ | 141 | 0.10 | 1.54 |
| " | 470 | VI-2 | 425 | | | " | 135 | 0.12 | 1.59 |
| " | 470 | VI-3 | 414 | | | " | 105 | 0.10 | 1.66 |
| VII-2 | 478 | | | | | | 100 | 0.11 | 1.75 |

TABLE III-continued

Speed and Dmin for FED Compounds with Various Broad Blue Dye Combinations

| Long Dye (Dye VII) | Peak Abs provided by Dye VII (nm) | Short Dye A (Dye VIA) | Peak Abs provided by Dye VIA (nm) | Short Dye B (Dye VIB) | Peak Abs provided by Dye VIB (nm) | Conc of FED (mol/mol Ag) | Photographic Sensitivity $S_{WR2B}$ | Dmin | Gamma |
|---|---|---|---|---|---|---|---|---|---|
| " | 477 | VI-1 | 438 | VI-3 | 415 | | 91 | 0.10 | 1.62 |
| " | 477 | VI-2 | 427 | | | | 91 | 0.09 | 1.67 |
| " | 477 | VI-3 | 413 | | | | 85 | 0.10 | 1.58 |
| " | 477 | VI-1 | 438 | VI-3 | 415 | $2.3 \times 10^{-5}$ | 145 | 0.11 | 1.56 |
| " | 477 | VI-2 | 427 | | | " | 162 | 0.12 | 1.52 |
| " | 477 | VI-3 | 413 | | | " | 129 | 0.11 | 1.55 |
| VII-3 | 467 | | | | | | 100 | 0.12 | 1.55 |
| " | 464 | VI-1 | 438 | | | | 78 | 0.11 | 1.66 |
| " | 464 | VI-2 | 424 | | | | 76 | 0.10 | 1.66 |
| " | 464 | VI-3 | 410 | | | | 72 | 0.10 | 1.62 |
| " | 464 | VI-1 | 438 | | | $2.3 \times 10^{-5}$ | 117 | 0.13 | 1.59 |
| " | 464 | VI-2 | 424 | | | " | 105 | 0.17 | 1.64 |
| " | 464 | VI-3 | 410 | | | " | 89 | 0.19 | 1.65 |

EXAMPLE 4

A multilayer film element was prepared with the fast yellow layer having the variations shown in Table IV.

TABLE IV

Multilayer Variations & Data

| TEST | Layer 3 Fast Yellow Emulsion | Relative Blue Sensitivity |
|---|---|---|
| 1 | Emulsion E-4 + Blue dye VII-1 | 100 |
| 2 | Emulsion E-4 + Blue dye VII-1 + Blue dye VI-1 | 79 |
| 3 | Emulsion E-4 + Blue dye VII-1 + Blue dye VI-1 + FED-2 | 98 |

The data in Table IV show that the loss in relative blue sensitivity associated with the use of a broad blue sensitization is also observed when the emulsion with this sensitization is coated in the yellow layer of a multilayer film element (Test 2 vs. Test 1). Addition of the fragmentable electron donor FED-2 brings the sensitivity of the layer with the broad blue sensitization back to the sensitivity of the layer with a single long blue dye (Test 3 vs Test 1). In this way, the color reproduction benefits of the broad blue sensitization can be obtained without loss of speed.

The following describes the preparation of the fast yellow emulsions used in Tests 1 to 3 of Table IV and the multilayer film element structure used for the tests:

An AgBrI tabular silver halide emulsion (Emulsion E-4) was prepared containing 2% total iodide distributed such that the central portion of the emulsion grains contained no iodide and the perimeter area contained substantially higher iodide as described by Chang et. al., U.S. Pat. No. 5,314,793. The emulsion grains had an average thickness of 0.14 $\mu$m and average circular diameter of 4.5 $\mu$m. The emulsion was precipitated using deionized gelatin and contained 0.37 molar parts per million of KSeCN per silver mole and 0.067 molar parts per million of potassium hexachloroiridate per silver mole both introduced at 69% of the precipitation. The emulsion was optimally chemically and spectrally sensitized by adding NaSCN, $8.27\times10^{-4}$ mole/mole Ag of the blue sensitizing dye VII-1 (Test 1) or $4.13\times10^{-4}$ mole/mole silver each of VII-1 and VI-1 (Tests 2 and 3), a mercaptotetrazole antifogging agent, $Na_3Au(S_2O_3)_2.2H_2O$, $Na_2S_2O_3.5H_2O$ and a benzothiazolium finish modifier. The emulsion was then subjected to a heat cycle to 60° C. The antifoggant-stabilizer, tetraazaindene, at a concentration of $5.81\times10^{-3}$ mole/mole silver, was added to the emulsion melt after the chemical sensitization procedure. For emulsions sensitized with the combination of dyes VII-1 and VI-1, another variant (Test 3) included adding the antifoggant, HB3, at a concentration of $1.29\times10^{-2}$ mole/mole silver followed by the fragmentable electron donor FED-2 at 0.3 mg/mole Ag subsequent to the tetraazaindene.

The Multilayer Film Structure utilized for this example is shown below, with structures of components immediately following. Component laydowns are provided in units of gm/sq m. (Bisvinylsulfonyl)methane hardener was added at 1.55% of total gelatin weight. Antifoggants (including 4-hydroxy-6-methyl-1,3,3a,7-tetraazaindene), surfactants, coating aids, coupler solvents, emulsion addenda, sequestrants, lubricants, matte and tinting dyes were added to the appropriate layers as is common in the art Multilayer Tests 1 to 3 all employ the same basic formula with variations summarized in Table IV. Samples of each element were given a stepped exposure to a light source with an effective color temperature of 5500° K. and processed in the KODAK FLEXICOLOR (C-41) process as described in *British Journal of Photography Annual*, 1988, pp 196–198. Relative sensitivity for the yellow dye-forming layers was evaluated at 0.15 density units above the minimum yellow density. Relative sensitivity was set equal to 100 for the multilayer element containing only a long blue dye (Test 1).

Layer 1 (Protective Overcoat Layer): gelatin at 0.89.

Layer 2 (UV Filter Layer): silver bromide Lippman emulsion at 0.269, UV-1 and UV-2 both at 0.108 and gelatin at 0.818.

Layer 3 (Fast Yellow Layer): blue sensitized silver emulsion variations as described in Table IV coated at 1.36, YC-1 at 0.420, IR-1 at 0.027, B-1 at 0.011, and gelatin at 2.26.

Layer 4 (Slow Yellow Layer): a blend of three blue sensitized (all with blue dye VII-1) tabular silver iodobromide emulsions (i) 1.3×0.13 $\mu$m, 4.5 mole % I at 0.333, (ii) 0.8×0.12 $\mu$m, 1.5 mole % I at 0.269, (iii)) 0.77×0.14 $\mu$m, 1.5 mole % I at 0.215, yellow dye forming coupler YC-1 at 0.732, IR-1 at 0.027 and gelatin at 2.26.

Layer 5 (Yellow filter layer): YFD-1 at 0.108, OxDS-1 at 0.075 and gelatin at 0.807.

Layer 6 (Fast Magenta Layer): a green sensitized (with a mixture of GSD-1 and GSD-2) silver iodobromide tabular emulsions (3.9×0.14 μm, 3.7 mole % iodide) at 1.29, magenta dye forming coupler MC-1 at 0.084, IR-2 at 0.003 and gelatin at 1.58.

Layer 7 (Mid Magenta Layer): a green sensitized (with a mixture of GSD-1 and GSD-2) silver iodobromide tabular emulsions: (i) 2.9×0.12 μm, 3.7 mole % iodide at 0.969, magenta dye forming coupler MC-1 at 0.082, Masking Coupler MM-1 at 0.086, IR-2 at 0.011 and gelatin at 1.56.

Layer 8 (Slow magenta layer): a blend of two green sensitized (both with a mixture of GSD-1 and GSD-2) silver iodobromide tabular emulsions: (i) 0.88×0.12 μm, 2.6 mole % iodide at 0.537 and (ii) 1.2×0.12 μm, 4.1 mole % iodide at 0.342, magenta dye forming coupler MC-1 at 0.285, Masking Coupler MM-1 at 0.075 and gelatin at 1.18.

Layer 9 (Interlayer): OxDS-1 at 0.075 and gelatin at 0538.

Layer 10 (Fast Cyan layer): a red-sensitized sensitized (with a mixture of RSD-1 and RSD-2) iodobromide tabular emulsion (4.0×0.13 μm, 4.0 mole % 1) at 0.130, cyan dye-forming coupler CC-2 at 0.205, IR-4 at 0.025, IR-3 at 0.022, OxDS-1 at 0.014 and gelatin at 1.45.

Layer 11 (Mid Cyan Layer): a red-sensitized sensitized (all with a mixture of RSD-1 and RSD-2) iodobromide tabular emulsion (2.2×0.12 μm, 3.0 mole % I) at 1.17, cyan dye-forming coupler CC-2 at 0.181, IR-4 at 0.011, masking coupler CM-1 at 0.032, OxDS-1 at 0.011 and gelatin at 1.61.

Layer 12 (Slow cyan layer): a blend of two red sensitized (all with a mixture of RSD-1 and RSD-2) silver iodobromide emulsions: (i) a large sized iodobromide tabular grain emulsion (1.2×0.12 μm, 4.1 mole % I) at 0.265, (ii) a smaller iodobromide tabular emulsion (0.74×0.12 μm), 4.1 mole % I) at 0.312, cyan dye-forming coupler CC-1 at 0.227, CC-2 at 0.363, masking coupler CM-1 at 0.032, bleach accelerator releasing coupler B-1 at 0.080 and gelatin at 1.67.

Layer 13 (Interlayer): OxDS-1 at 0.075 and gelatin at 0.538.

Layer 14 (Antihalation layer): Black Colloidal Silver at 0.151, UV-1 and UV-2 both at 0.075 and gelatin at 1.61.

Chemical Structures

UV-1

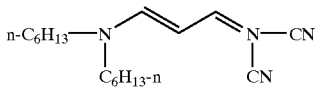

UV-2

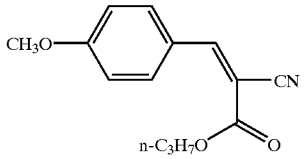

YC-1

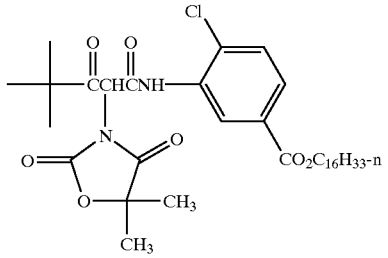

-continued

YFD-1

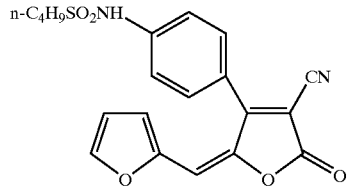

MC-1

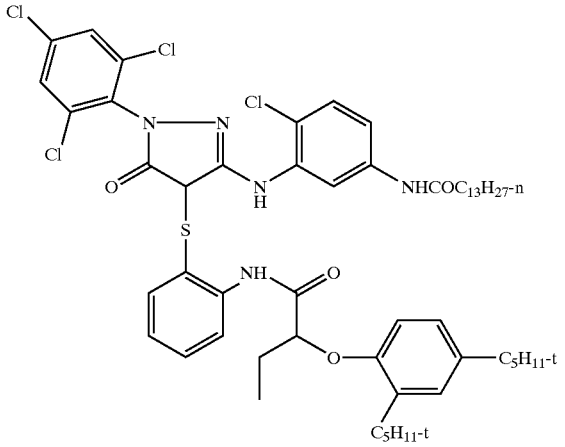

MM-1

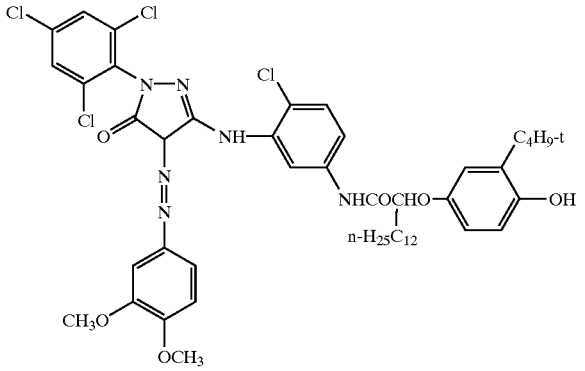

CC-1

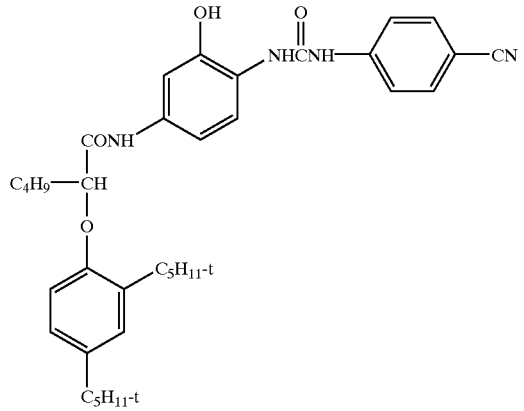

-continued
CM-1
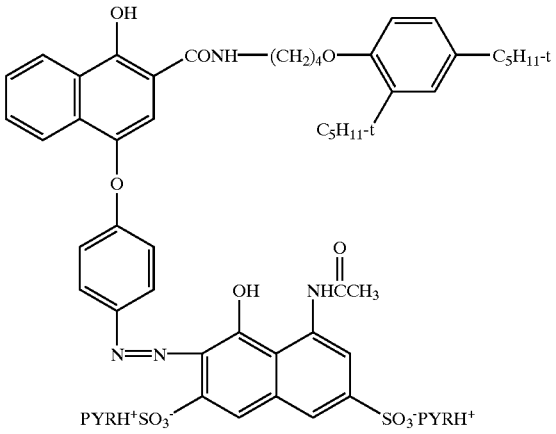
CC-2
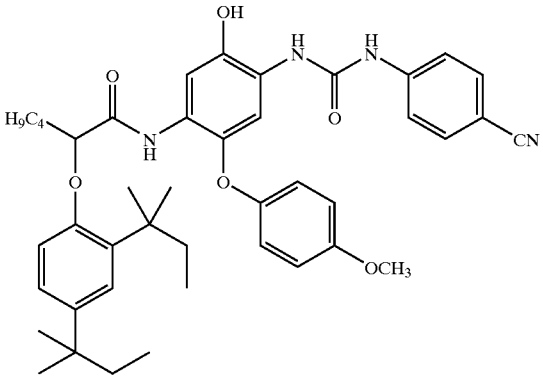
B-1
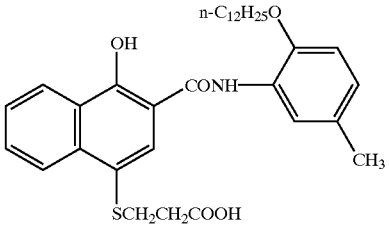
OxDS-1
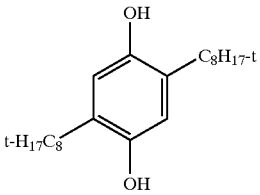
OxDS-2
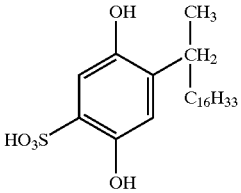
-continued
IR-1
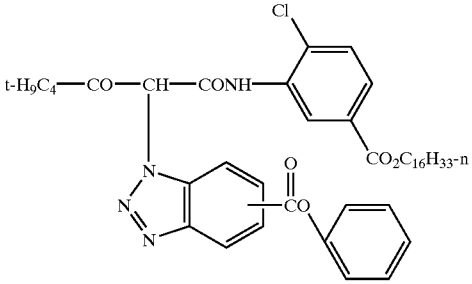
IR-2
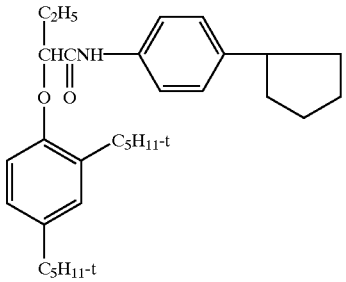
IR-3
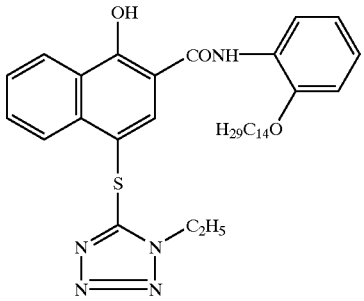
IR-4
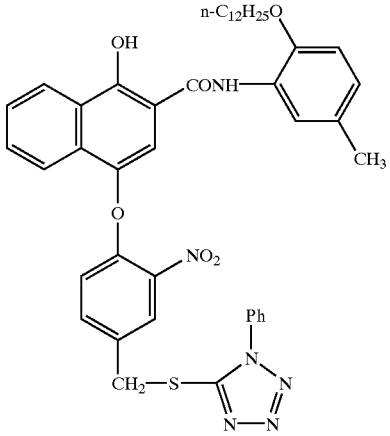
GSD-1
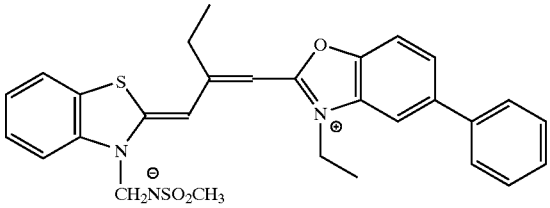

-continued

RSD-1

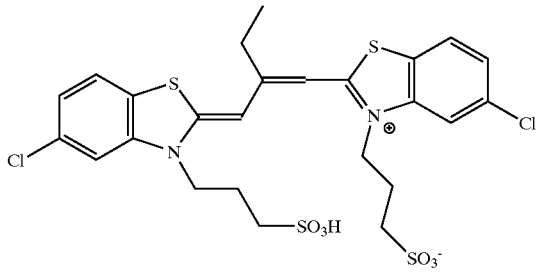

RSD-2

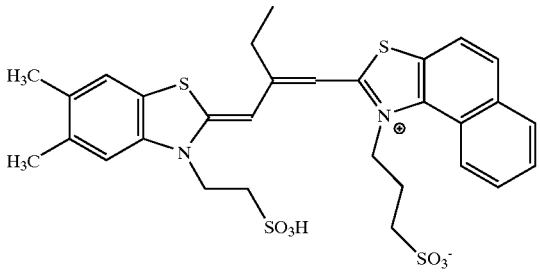

GSD-2

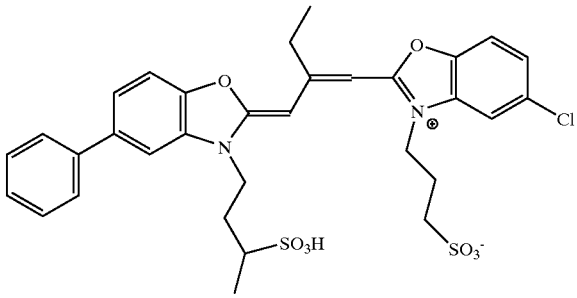

EXAMPLE 5

A large, thin tabular AgBrI emulsion (E-5) was precipitated using techniques similar to those described in U.S. Pat. No. 569127. The final emulsion contained 1.5 mole % iodide uniformly distributed after the first 0.1% of the precipitation. The emulsion had a mean thickness of 0.07 $\mu$m, and a mean diameter of 5.88 $\mu$m. The emulsion was optimally chemically and spectrally sensitized by adding $1.64\times10^{-3}$ mole of HB3, NaSCN, $1.16\times10^{-3}$ mole/mole Ag of the blue sensitizing dye VII-1 or $0.58\times10^{-3}$ mole/mole silver each of VII-1 and VI-1,), carboxymethyl-trimethyl-2-thiourea, bis (1,4,5-trimethyl-1,2,4-triazolium-3-thiolate) gold(I) tetrafluoroborate,and a benzothiazolium finish modifier and then subjecting the emulsion to a heat cycle to 55° C. for 15 minutes. The antifoggant-stabilizer, 1-(3-acetamidophenyl)-5-mercaptotetrazole, at a concentration of $4.0\times10^{-4}$ mole/mole silver, was added to the emulsion melt after the chemical sensitization procedure. For some experimental variations, the electron donating sensitizing agent, FED-2, was then added to the emulsion, as listed in Table V.

The melts were prepared for coating by adding additional water, and gelatin. Coatings were prepared by combining the emulsion melts with a melt containing gelatin, coating surfactants, additional HB3, and an aqueous dispersion of the yellow-forming color coupler YY-4 and coating the resulting mixture on acetate support. The final coatings contained Ag at 50 mg/ft$^2$, YY-4 coupler at 85 mg/ft$^2$, and gelatin at 75 mg/ft$^2$. The coatings were overcoated with a protective layer containing gelatin at 250 mg/ft$^2$, coating surfactants, and a bisvinylsulfonylmethyl ether as a gelatin hardening agent.

For photographic evaluation, each of the coating strips was exposed for 0.01 sec to a 3000° K. color temperature tungsten lamp filtered to give an effective color temperature of 5500° K. and further filtered through a Kodak Wratten filter number 2B and a step wedge ranging in density from 0 to 4 density units in 0.2 density steps. This filter passes only light of wavelengths longer than 400 nm, thus giving light absorbed mainly by the sensitizing dye. The exposed film strips were processed in Eastman Kodak C-41 developer. Speed was metered at 0.15 density units above the Dmin density. Relative sensitivity was set equal to 100 for the multilayer element containing only a long blue dye.

TABLE V

| | Dye VI-1 | Dye VII-1 | FED-2 (mg/mole Ag) | D + .15 speed | Dmin |
|---|---|---|---|---|---|
| Comparison | 0.00 | 1.16 (single dye) | 0 | 100 | 0.10 |
| Comparison | 0.58 | 0.58 | 0 | 79 | 0.13 |
| Invention | 0.58 | 0.58 | 0.326 | 93 | 0.13 |
| Invention | 0.58 | 0.58 | 1.96 | 125 | 0.15 |

The data in Table V show that combination of the short blue dye VI-1 the long blue dyes VII-1 results in a speed loss for this WR2B exposure compared to the long blue dye alone. Addition of the fragmentable electron donating sensitizer FED-2 to the dye combination restores this lost speed and can also give speed that is somewhat greater than the long blue dye alone, at the price of slight additional fog. Consequently, the data in Table V show that the fragmentable electron donating sensitizers can be used with this thin tabular grain to provide a broad blue sensitization that has speed at least equivalent to the speed of a long blue dye alone. In this way, the requirements of both speed and color reproduction can be met, allowing the additional benefits that can be realized in color multilayers by minimizing coated silver laydown with thin tabular emulsions to be obtained without sacrificing color reproduction.

EXAMPLE 6

A thin, tabular monodisperse silver bromide emulsion (Emulsion E-6) was prepared with growth modifier, Pluronic-31R1™ (a sequenced copolymer of polyethylene oxide and polypropylene oxide in solution in methanol, marketed by BASF) to produce grains of a uniform size. A description of the growth modifier can be found in Tsaur, U.S. Ser. No. 08/724,716 filed Sep. 30, 1996, the entire disclosure of which is incorporated herein by reference. Into a reaction vessel with good mixing was added 6 L of distilled water, 3 g of oxidized lime-processed bone gelatin, 3.76 g of sodium bromide, and 0.42 g of Pluronic-31™. While keeping the temperature at 30° C., an aqueous solution consisting of 0.35 M silver nitrate was added at the rate of 14.3 mL/min simultaneously with the addition of a solution consisting of 0.35 M sodium bromide at the rate of 14.3 mL/min for a period of 1 min. The vessel temperature was then raised to 60° C. over a period of 18 min and 100 g of oxidized, lime-processed, bone gelatin with 0.1 g Pluronic-31™ in 1.5 L of distilled water was added. The pH was then adjusted to 5.4 with 45 mL of 2.5 M sodium hydroxide. Growth was initiated with a 0.35 M silver nitrate solution added at the rate of 14.3 mL/min simultaneously with a 0.35 M sodium bromide solution added at such a rate as to maintain the pBr at 1.93. Throughout the growth segments, sodium bromide flow was always balanced against the silver nitrate flow to maintain a pBr of 1.93. During the following 15 min the flow of silver nitrate was increased to 58.3 mL/min. A silver nitrate solution of 1.6 M was then added simultaneously with a 1.679 M sodium bromide at an increasing rate beginning at 12.3 mL/min and ending at 70 mL/min over a period of 70 min. The flow of silver nitrate was then continued for an additional 20.24 min at 70 mL/min with a balanced flow of sodium bromide. The emulsion was then cooled to 45° C. and excess salt removed by ultrafiltration. The total yield was 7.06 moles of a tabular emulsion with a size of 4.66×0.059 $\mu$m.

Emulsion E-6 was sensitized by the following procedure. Emulsion E-6 was treated sequentially with antifoggant, HB3; sodium thiocyanate; finish modifier, FM; sensitizing dyes, Dye VII-1 and Dye VI-1; gold sensitizer, trisodium aurous (I) dithiosulfate, as a combined sulfur and gold source, and disodium thiosulfate as an additional sulfur source. The emulsion was heated for 10 min at 64° C., cooled to 40° C., and treated with antifoggants, AF-1 and AF-2. The resulting emulsion, Emulsion E-6a (comparative), was then coated in a simple, single layer format, processed, and evaluated as described below.

Examples 6b, c, d, e (Invention) were prepared as above except that following the addition of AF-2, varying amounts of FED-2 were added as shown in Table VI. The emulsions were each coated in a single layer format, processed, and evaluated as described below.

The blue spectrally sensitized emulsion samples were coated in a simple single layer format which consisted of a pad of gelatin on a cellulose acetate film support with an antihalation backing covered by a layer containing the emulsion and the yellow image forming coupler, C-1, together with a yellow development inhibitor releasing coupler, C-2. The emulsion layer was protected from abrasion by a gelatin overcoat containing hardener. A detailed description of the layered structure is described below.

Single Layer Format

| Coated Layer | Composition |
|---|---|
| Protective Overcoat | 2.15 g/m$^2$ gelatin |
| Emulsion/Coupler | 3.23 g/m$^2$ gelatin |
| | 0.86 mg/m$^2$ Ag |
| | 1.08 g/m$^2$ coupler C-1 |
| | 0.3 g/m$^2$ coupler C-2 |
| | 0.004 g/m$^2$ antifoggant AF-2 |
| Gelatin Pad | 4.89 g/m$^2$ gelatin |
| Support | Cellulose Acetate |

The dried coated samples were given 0.01 s Wratten 2B filtered daylight (5500° K.) exposure through a 21 step calibrated neutral density step tablet. The exposed samples were developed in the color negative Kodak Flexicolor™ C41 process. Relative sensitivity was measured at a density of 0.15 above D-min.

TABLE VI

| Example | FED (mg/mol) | Dmin Increase | Speed |
|---|---|---|---|
| 6a (Comparison) | 0 | NA | 100 |
| 6b (Invention) | 0.25 | 0.05 | 151 |
| 6c (Invention) | 0.50 | 0.06 | 186 |

TABLE VI-continued

| Example | FED (mg/mol) | Dmin Increase | Speed |
|---|---|---|---|
| 6d (Invention) | 1.00 | 0.07 | 191 |
| 6e (Invention) | 2.00 | 0.12 | 214 |

The data show that when a thin, tabular silver bromide emulsion with a broad blue spectral sensitization was treated with increasing amounts of a FED compound, the photographic speed increased in proportion without an undue increase in fog (Examples 6b, c, d, e, Table VI). This increase in speed permits the use of smaller grain emulsions to produce a film of a given speed leading to lower granularity. Alternatively, the extra speed could be used to reduce silver coverage and effect a cost savings or to produce less light scatter in underlying layers.

FM

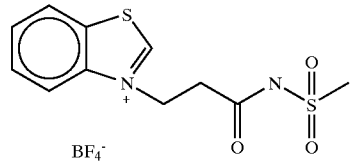

AF-1

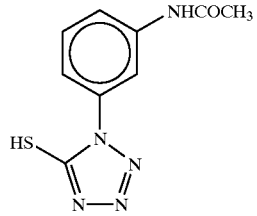

AF-2

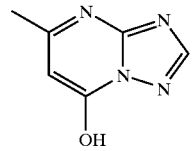

C-1

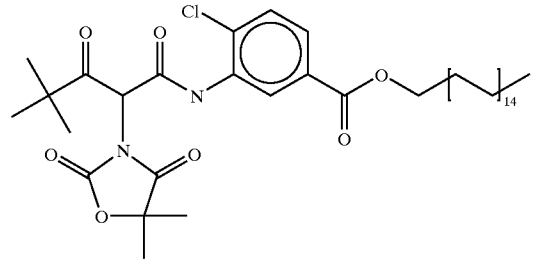

C-2

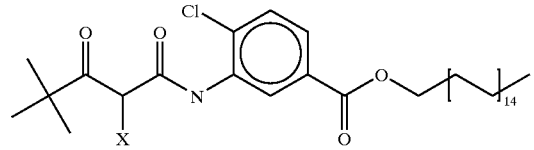

-continued

X =

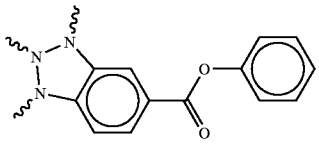

The invention has been described in detail with particular reference to certain preferred embodiments thereof, but it will be understood that variations and modifications can be effected within the spirit and scope of the invention.

What is claimed is:

1. A photographic element comprising a support and at least one blue sensitive silver halide emulsion layer containing a tabular grain silver halide emulsion spectrally sensitized with at least one dye providing a peak sensitization between 446 and 500 nm and at least one dye providing a peak sensitization between 400 and 445 nm and additionally sensitized with a fragmentable electron donor of the formula:

$$Q—X—Y'$$

$$A—(X—Y')_k$$

$$(A)_k—X—Y'$$

$$Z—(X—Y')_k$$

or $$(Z)_k—X—Y'$$

wherein:

Z is a light absorbing group;

k is 1 or 2;

A is a silver halide adsorptive group; and

Q represents the atoms necessary to form a chromophore comprising an amidinium-ion, a carboxyl-ion or dipolar-amidic chromophoric system when conjugated with X—Y';

X is an electron donor moiety, Y' is a leaving proton H or a leaving group Y, with the proviso that if Y' is H a base, β, is covalently linked directly or indirectly to X and wherein:

1) X—Y' has an oxidation potential between 0 and about 1.4 V; and 2) the oxidized form of X—Y' fragments to give the radical $X^{\bullet}$ and the leaving fragment Y'; and, optionally, 3) the radical $X^{\bullet}$ has an oxidation potential ≦0.7 V.

2. A photographic element according to claim 1, wherein X is of structure (I):

(I)

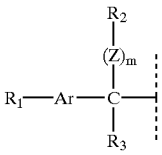

$R_1$=R, carboxyl, amide, sulfonamide, halogen, $NR_2$, $(OH)_n$, $(OR')_n$, or $(SR)_n$;

R'=alkyl or substituted alkyl;

n=1–3;

$R_2$=R, or Ar';

$R_3$=R, or Ar';

$R_2$ and $R_3$ together can form a 5- to 8-membered ring:

Ar=aryl group;

m=0, or 1;

Z=O, S, Se, or Te;

$R_2$ and Ar= can be linked to form a 5- to 8-membered ring;

$R_3$ and Ar= can be linked to form a 5- to 8-membered ring;

Ar'=aryl group, or heterocyclic group; and

R=a hydrogen atom or an unsubstituted or substituted alkyl group.

3. A photographic element according to claim 2, wherein the compound of Structure (I) is selected from:

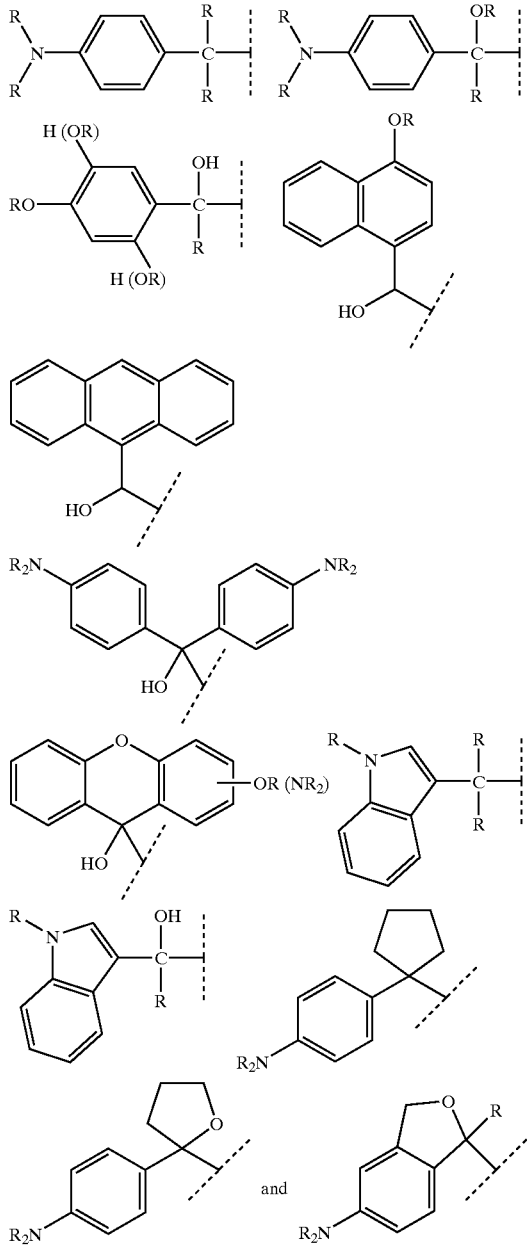

wherein R=a hydrogen atom or an unsubstituted or substituted alkyl group.

4. A photographic element according to claim 1, wherein X is a compound of structure (II):

(II)

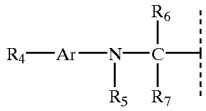

wherein:

Ar=aryl group;

$R_4$=a substituent having a Hammett sigma value of −1 to +1;

$R_5$=R, or Ar';

$R_6$=R, Ar'or, if $R_6$ is linked to Ar, $R_6$ can be a hetero atom;

$R_7$=R, or Ar';

$R_5$ and Ar═ can be linked to form a 5- to 8-membered ring;

$R_6$ and Ar═ can be linked to form a 5- to 8-membered ring;

$R_5$ and $R_6$ can be linked to form a 5- to 8-membered ring;

$R_6$ and $R_7$ can be linked to form a 5- to 8-membered ring;

Ar'=aryl group;

and

R=hydrogen atom or an unsubstituted or substituted alkyl group.

5. A photographic element according to claim 4, wherein X is selected from:

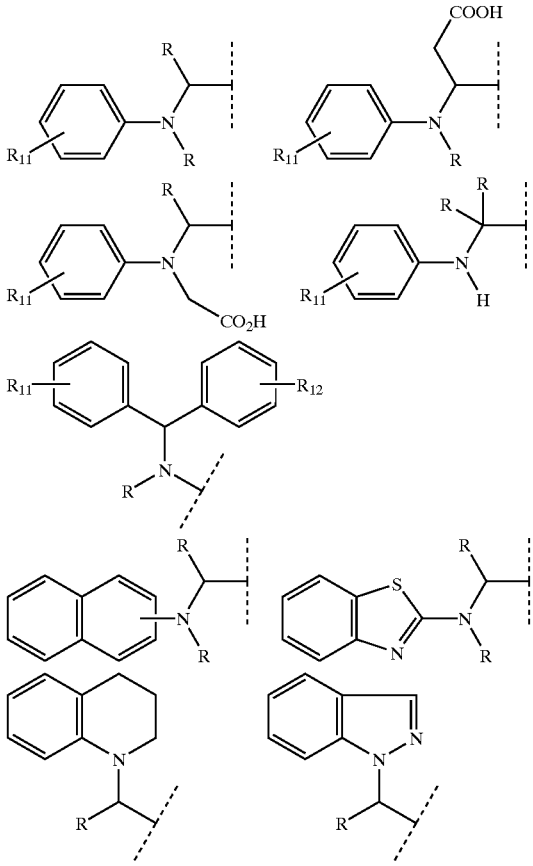

-continued

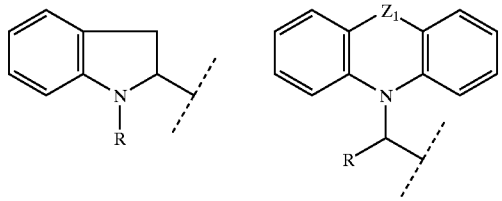

and

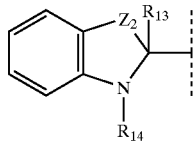

$R_{11}$ and $R_{12}$ = { H, alkyl, alkoxy, alkylthio, halo, carbamoyl, carboxyl, amido, formyl, sulfonyl, sulfonamido, or nitrile }

$Z_1$=a covalent bond, S, O, Se, NR, $CR_2$, CR═CR, or $CH_2CH_2$;

$Z_2$=S, O, Se, NR, $CR_2$, or CR═CR;

$R_{13}$=alkyl, substituted alkyl or aryl;

$R_{14}$=H, alkyl substituted alkyl or aryl; and

R=a hydrogen atom or an unsubstituted or substituted alkyl group.

6. A photographic element according to claim 1, wherein X is a compound of structure (III):

(III)

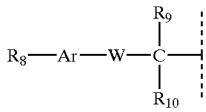

wherein:

W=O, S, or Se;

Ar=aryl group or heterocyclic group;

$R_8$=R, carboxyl, $NR_2$, $(OR)_n$, or $(SR)_n$ (n=1–3);

$R_9$ and $R_{10}$=R, or Ar';

$R_9$ and Ar═ can be linked to form a 5- to 8-membered ring;

Ar'=aryl group; and

R=a hydrogen atom or an unsubstituted or substituted alkyl group.

7. A photographic element according to claim 6, wherein X is selected from:

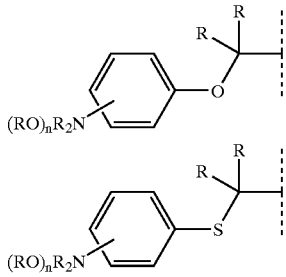

-continued

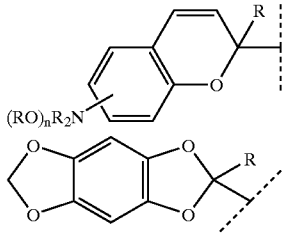

and

R=a hydrogen atom or an unsubstituted or substituted alkyl group.

8. A photographic element according to claim 1, wherein X is of structure (IV):

(IV)

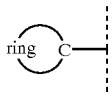

wherein:

"ring" represents a substituted or unsubstituted 5-, 6- or 7-membered unsaturated ring.

9. A photographic element according to claim 8, wherein X is selected from:

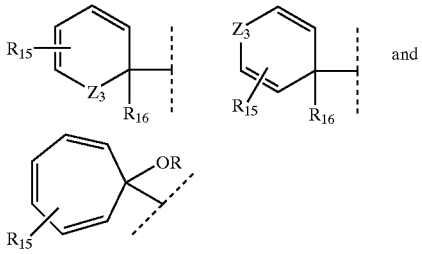

and $Z_3$=O, S, Se, or NR;

$R_{15}$=R, OR, or $NR_2$;

$R_{16}$=alkyl, substituted alkyl; and

R=a hydrogen atom or an unsubstituted or substituted alkyl group.

10. A photographic element according to claim 1, wherein Y' is selected from (1) through (5):

(1) X', where X' is an X group as defined in structures I–IV and may be the same as or different from the X group to which it is attached;

(2)

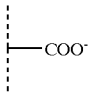

(3)

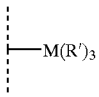

where M=Si, Sn or Ge; and R'=alkyl or substituted alkyl (4)

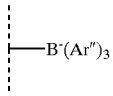

where Ar"=aryl or substituted aryl (5)

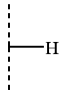

wherein structures I–IV are as follows:

(I)

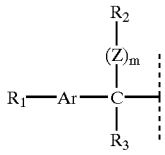

$R_1$=R, carboxyl, amide, sulfonamide, halogen, $NR_2$, $(OH)_n$, $(OR')_n$, or $(SR)_n$;

R'=alkyl or substituted alkyl;

n=1–3;

$R_2$=R, or Ar';

$R_3$=R, or Ar';

$R_2$ and $R_3$ together can form a 5- to 8-membered ring:

Ar=aryl group;

m=0, 1;

Z=O, S, Se, or Te;

$R_2$ and Ar= can be linked to form a 5- to 8-membered ring;

$R_3$ and Ar= can be linked to form a 5- to 8-membered ring;

Ar'=aryl group, or heterocyclic group; and

R=a hydrogen atom or an unsubstituted or substituted alkyl group;

(II)

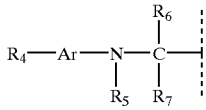

wherein:

Ar=aryl group;

$R_4$=a substituent having a Hammett sigma value of −1 to +1;

$R_5$=R, or Ar';

$R_6$=R, Ar'or, if $R_6$ is linked to Ar, $R_6$ can be a hetero atom;

$R_7$=R, or Ar';

$R_5$ and Ar= can be linked to form a 5- to 8-membered ring;

$R_6$ and Ar= can be linked to form a 5- to 8-membered ring;

$R_5$ and $R_6$ can be linked to form a 5- to 8-membered ring;

$R_6$ and $R_7$ can be linked to form a 5- to 8-membered ring;

Ar'=aryl group; and

R=hydrogen atom or an unsubstituted or substituted alkyl group;

(III)

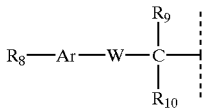

wherein:

W=O, S, or Se;

Ar=aryl group or heterocyclic group;

$R_8$=R, carboxyl, $NR_2$, $(OR)_n$, or $(SR)_n$ (n=1–3);

$R_9$ and $R_{10}$=R, or Ar';

$R_9$ and Ar= can be linked to form a 5- to 8-membered ring;

Ar'=aryl group; and

R=a hydrogen atom or an unsubstituted or substituted alkyl group;

(IV)

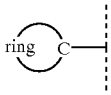

wherein:

"ring" represents a substituted or unsubstituted 5-, 6- or 7-membered unsaturated ring.

11. A photographic element according to claim 1, wherein the fragmentable electron donor compound is selected from the group consisting of:

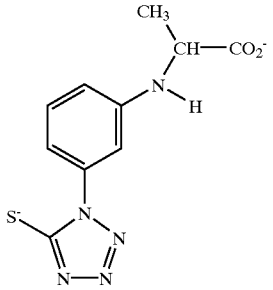

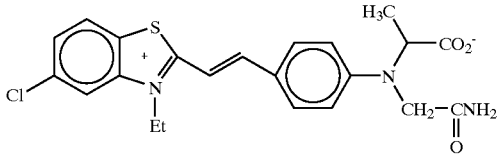

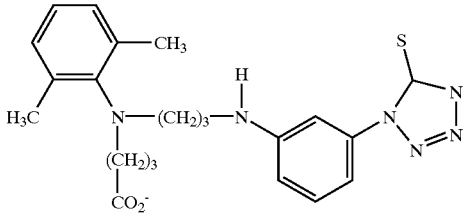

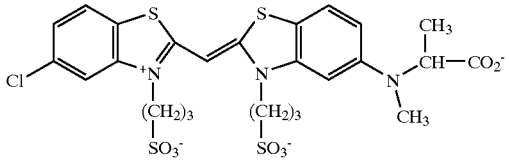

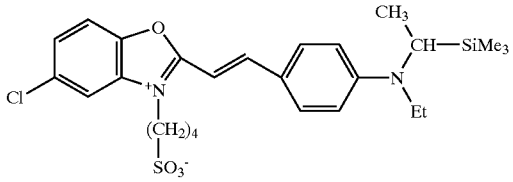

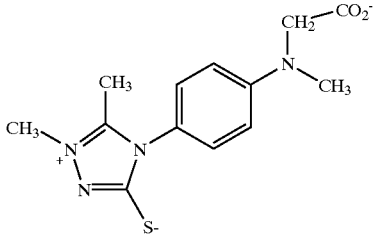

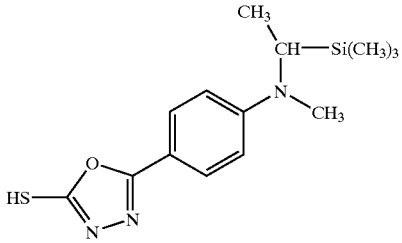

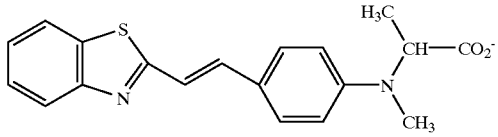

-continued

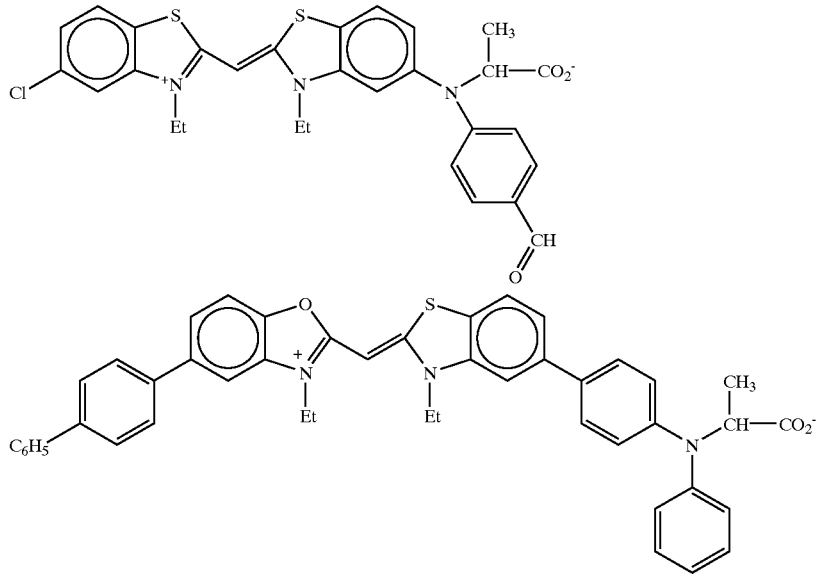

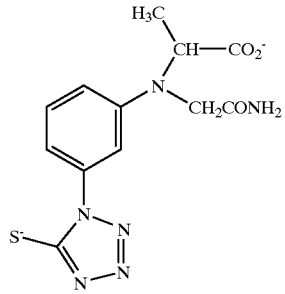

and

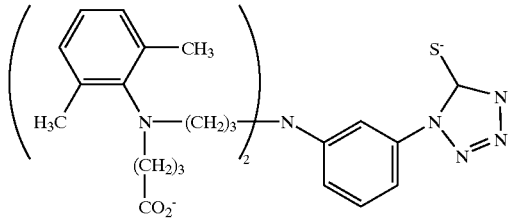

12. A photographic element according to claim 1, wherein the dye providing a peak sensitization between 446 and 500 nm is of formula (VII)

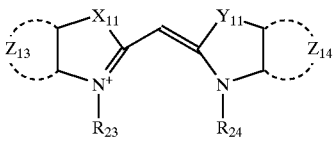

(VII)

wherein:

$Z_{13}$ and $Z_{14}$, independently represent the atoms necessary to complete a substituted or unsubstituted benzene or naphthylene;

$X_{11}$ and $Y_{11}$ are independently O, S, Se or $NR_{25}$, wherein $R_{25}$ is an alkyl, alkenyl, aryl, any of which may be substituted or unsubstituted;

$R_{23}$ and $R_{24}$ independently represent and alkyl, alkenyl or aryl, any or which may be substituted or unsubstituted.

13. A photographic element according to claim 1, wherein the dye providing a peak sensitization between 400 and 445 nm is of structure (VI):

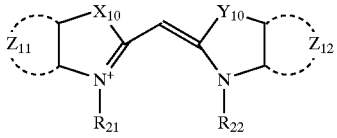

(VI)

wherein:

$Z_{11}$ and $Z_{12}$ independently represent the atoms necessary to complete a substituted or unsubstituted benzene or naphthylene;

$X_{10}$ and $Y_{10}$, are independently O, S, Se or $NR_{25}$, provided that at least $X_{10}$ or $Y_{10}$ is O or $NR_{25}$, wherein $R_{25}$ is an alkyl, alkenyl or aryl any of which may be substituted or unsubstituted;

$R_{21}$ and $R_{22}$ independently represent an alkyl, alkenyl or aryl group any of which may be substituted or unsubstituted.

14. A photographic element according to claim 13, wherein the dye of structure (VI) is of structure (VIa) or (VIb):

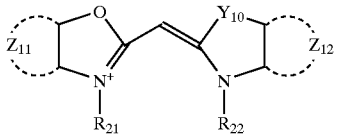

(VIa)

-continued (VIb)

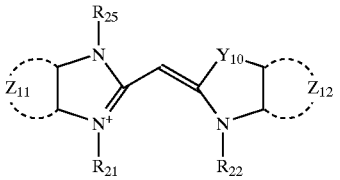

wherein:

$Z_{11}$ and $Z_{12}$ independently represent the atoms necessary to complete a substituted or unsubstituted benzene or naphthylene;

$Y_{10}$, is O, S or Se $R_{25}$ is an alky, alkenyl or aryl, any of which may be substituted or unsubstituted;

$R_{21}$ and $R_{22}$ independently represent an alkyl, alkenyl or aryl group any of which may be substituted or unsubstituted.

15. A photographic element according to claim 1, wherein the tabular grains have thicknesses of <0.3 μm.

16. A photographic element according to claim 1, wherein the tabular grains have a thickness of <0.07 μm.

17. A photographic element comprising a support and at least one blue sensitive silver halide emulsion layer containing a silver halide emulsion in which the halide content is at least about 50% chloride and no more than 5% iodide, wherein the emulsion is spectrally sensitized with at least one dye providing a peak sensitization between 446 and 500 nm and at least one dye providing a peak sensitization between 400 and 445 nm and is additionally sensitized with a fragmentable electron donor of the formula $$Q—X—Y'$$

$$A—(X—Y')_k$$

$$(A)_k—X—Y'$$

$$Z—(X—Y')_k$$

or $$(Z)_k—X—Y'$$

wherein:

Z is a light absorbing group;

k is 1 or 2;

A is a silver halide adsorptive group; and

Q represents the atoms necessary to form a chromophore comprising an amidinium-ion, a carboxyl-ion or dipolar-amidic chromophoric system when conjugated with X—Y';

X is an electron donor moiety, Y' is a leaving proton H or a leaving group Y, with the proviso that if Y' is H a base, β, is covalently linked directly or indirectly to X and wherein:

1) X—Y' has an oxidation potential between 0 and about 1.4 V; and 2) the oxidized form of X—Y' fragments to give the radical $X^{\bullet}$ and the leaving fragment Y'; and, optionally, 3) the radical $X^{\bullet}$ has an oxidation potential ≦0.7 V.

18. A photographic element according to claim 17, wherein X is of structure (I):

(I)

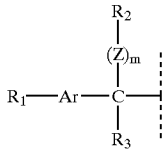

wherein:

$R_1$=R, carboxyl, amide, sulfonamide, halogen, $NR_2$, $(OH)_n$, $(OR')_n$, or $(SR)_n$;

R'=alkyl or substituted alkyl;

n=1–3;

$R_2$=R, or Ar';

$R_3$=R, or Ar';

Ar=aryl group;

$R_2$ and $R_3$ together can form a 5- to 8-membered ring;

m=0, 1;

Z=O, S, Se, or Te;

$R_2$ and Ar═ can be linked to form a 5- to 8-membered ring;

$R_3$ and Ar═ can be linked to form a 5- to 8-membered ring;

Ar'=aryl group; or heterocyclic group; and

R=a hydrogen atom or an unsubstituted or substituted alkyl group.

19. A photographic element according to claim 18, wherein the compound of Structure (I) is selected from:

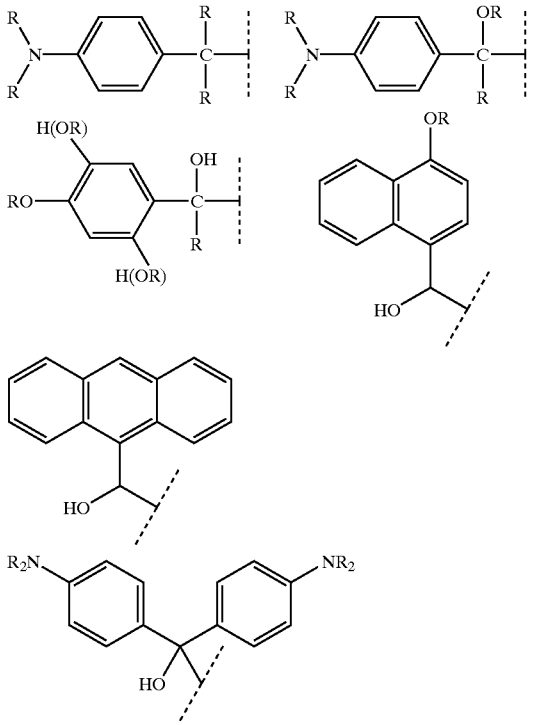

-continued

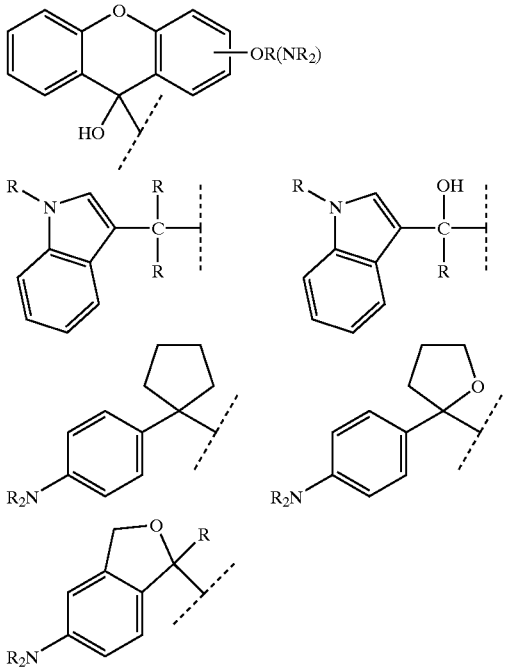

wherein each R is independently a hydrogen atom or a substituted or unsubstituted alkyl group.

20. A photographic element according to claim 17, wherein X is a compound of structure (II):

(II)

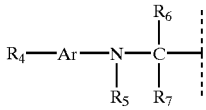

wherein:

Ar=aryl group, or heterocyclic group;

$R_4$=a substituent having a Hammett sigma value of −1 to +1;

$R_5$=R, or Ar';

$R_6$=R, Ar' or, if $R_6$ is linked to Ar, $R_6$ can be a hetero atom;

$R_7$=R, or Ar';

$R_5$ and Ar═ can be linked to form a 5- to 8-membered ring;

$R_6$ and Ar═ can be linked to form a 5- to 8-membered ring;

$R_5$ and $R_6$ can be linked to form a 5- to 8-membered ring;

$R_6$ and $R_7$ can be linked to form a 5- to 8-membered ring;

Ar'=aryl group or heterocyclic group; and

R=hydrogen atom or an unsubstituted or substituted alkyl group.

21. A photographic element according to claim 17, wherein X is a compound of structure (III):

(III)

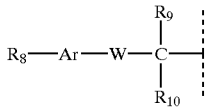

wherein:

W=O, S, or Se;

Ar=aryl group; or heterocyclic group;

$R_8$=R, carboxyl, $NR_2$, $(OR)_n$, or $(SR)_n$ (n=1–3);

$R_9$ and $R_{10}$=R, or Ar';

$R_9$ and Ar═ can be linked to form a 5- to 8-membered ring;

Ar'=aryl group or heterocyclic group; and

R=a hydrogen atom or an unsubstituted or substituted alkyl group.

22. A photographic element according to claim 21, wherein X is selected from:

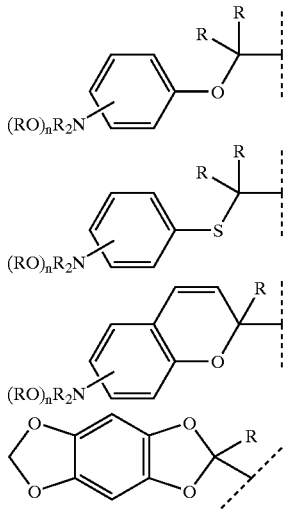

and

23. A photographic element according to claim 17, wherein X is of structure (IV):

(IV)

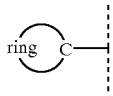

wherein:

"ring" represents a substituted or unsubstituted 5-, 6- or 7-membered unsaturated ring.

24. A photographic element according to claim 23, wherein X is selected from:

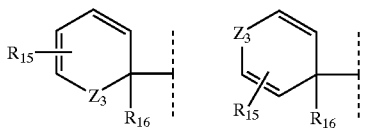

and

-continued

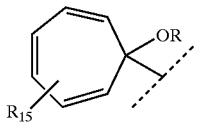

$Z_3$=O, S, Se, or NR;

$R_{15}$=R, OR, or $NR_2$;

$R_{16}$=alkyl, or substituted alkyl; and

R=a hydrogen atom or an unsubstituted or substituted alkyl group.

25. A photographic element according to claim 17, wherein Y' is selected from (1) through (5):

(1) X', where X' is an X group as defined in structures I–IV and may be the same as or different from the X group to which it is attached, (2)

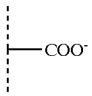

(3)

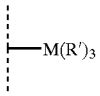

where M=Si, Sn or Ge; and R'=alkyl or substituted alkyl (4)

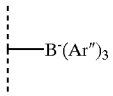

where Ar"=aryl or substituted aryl (5)

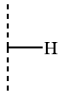

wherein structures I–IV are as follows:

(I)

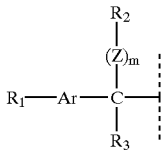

$R_1$=R, carboxyl, amide, sulfonamide, halogen, $NR_2$, $(OH)_n$, $(OR')_n$, or $(SR)_n$;

R'=alkyl or substituted alkyl;

n=1–3;

$R_2$=R, or Ar';

$R_3$=R, or Ar';

$R_2$ and $R_3$ together can form a 5- to 8-membered ring:

Ar=aryl group;

m=0, 1;

Z=O, S, Se, or Te;

$R_2$ and Ar═ can be linked to form a 5- to 8-membered ring;

$R_3$ and Ar═ can be linked to form a 5- to 8-membered ring;

Ar'=aryl group, or heterocyclic group; and

R=a hydrogen atom or an unsubstituted or substituted alkyl group;

(II)

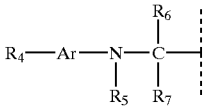

wherein:

Ar=aryl group;

$R_4$=a substituent having a Hammett sigma value of −1 to +1;

$R_5$=R, or Ar';

$R_6$=R, Ar'or, if $R_6$ is linked to Ar, $R_6$ can be a hetero atom;

$R_7$=R, or Ar';

$R_5$ and Ar═ can be linked to form a 5- to 8-membered ring;

$R_6$ and Ar═ can be linked to form a 5- to 8-membered ring;

$R_5$ and $R_6$ can be linked to form a 5- to 8-membered ring;

$R_6$ and $R_7$ can be linked to form a 5- to 8-membered ring;

Ar'=aryl group; and

R=hydrogen atom or an unsubstituted or substituted alkyl group;

(III)

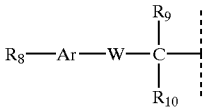

wherein:

W=O, S, or Se;

Ar=aryl group or heterocyclic group;

$R_8$=R, carboxyl, $NR_2$, $(OR)_n$, or $(SR)_n$ (n=1–3);

$R_9$ and $R_{10}$=R, or Ar';

$R_9$ and Ar═ can be linked to form a 5- to 8-membered ring;

Ar'=aryl group; and

R=a hydrogen atom or an unsubstituted or substituted alkyl group;

(IV)

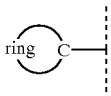

wherein:

"ring" represents a substituted or unsubstituted 5-, 6- or 7-membered unsaturated ring.

26. A photographic element according to claim 17, wherein the fragmentable electron donor compound is selected from the group consisting of:

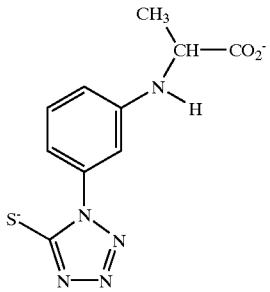
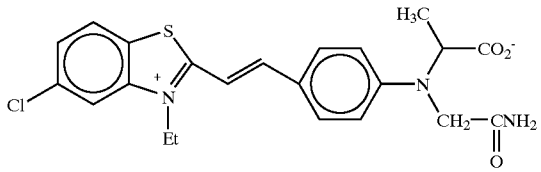
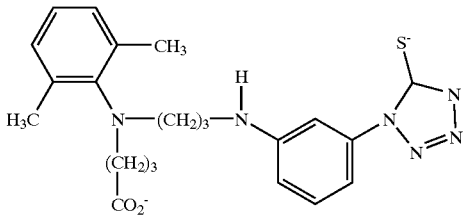
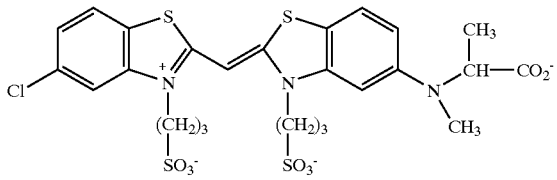
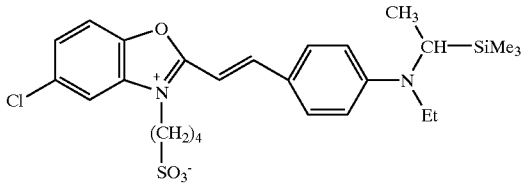
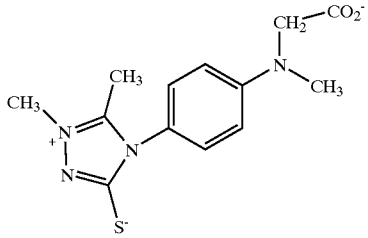
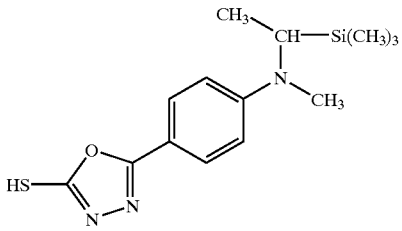
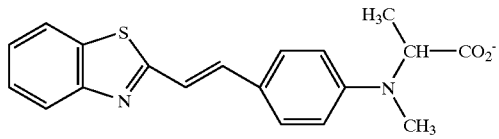
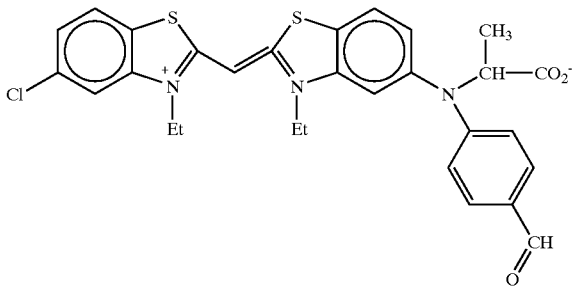
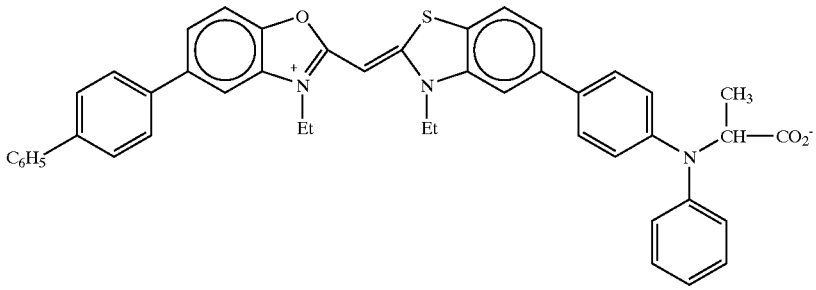

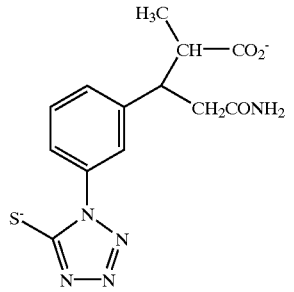

and

-continued

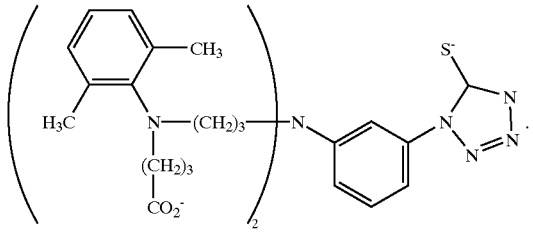

27. A photographic element according to claim 26, wherein the dye providing a peak sensitization between 446 and 500 nm is of formula (VII)

(VII)

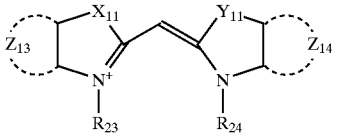

wherein:

$Z_{13}$ and $Z_{14}$, independently represent the atoms necessary to complete a substituted or unsubstituted benzene or naphthylene;

$X_{11}$ and $Y_{11}$ are independently O, S, Se or $NR_{25}$, wherein $R_{25}$ is an alkyl, alkenyl or aryl, any of which may be substituted or unsubstituted;

$R_{23}$ and $R_{24}$ independently represent and alkyl, alkenyl or aryl, any or which may be substituted or unsubstituted.

28. A photographic element according to claim 27, wherein the dye of structure (VI) is of structure (VIa) or (VIb):

(VIa)

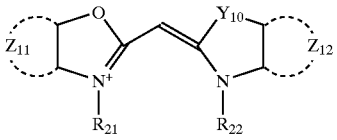

(VIb)

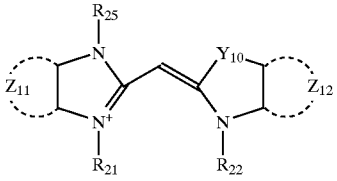

wherein:

$Z_{11}$ and $Z_{12}$ independently represent the atoms necessary to complete a substituted or unsubstituted benzene or naphthalene;

$Y_{10}$, is O, S or Se $R_{25}$ is an alkyl, alkenyl or aryl, any of which may be substituted or unsubstituted;

$R_{21}$ and $R_{22}$ independently represent an alkyl, alkenyl or aryl group any of which may be substituted or unsubstituted.

29. A photographic element according to claim 17, wherein the dye providing a peak sensitization between 400 and 445 nm is of structure (VI):

(VI)

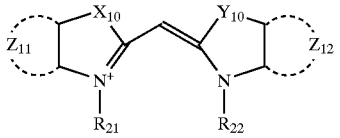

wherein:

$Z_{11}$ and $Z_{12}$ independently represent the atoms necessary to complete a substituted or unsubstituted benzene or naphthylene;

$X_{10}$ and $Y_{10}$, are independently O, S, Se or $NR_{25}$, provided that at least $X_{10}$ or $Y_{10}$ is O or $NR_{25}$, wherein $R_{25}$ is an alkyl, alkenyl or aryl, any of which may be substituted or unsubstituted;

$R_{21}$ and $R_{22}$ independently represent an alkyl, alkenyl or aryl group any of which may be substituted or unsubstituted.

30. A photographic element according to claim 1, wherein the fragmentable electron donor compound is of the formula:

$$Z—(X—Y')_k$$

or $$(Z)_k—X—Y'$$

wherein Z is derived from a cyanine dye, complex cyanine dye, merocyanine dye, complex merocyanine dye, homopolar cyanine dye, styryl dye, oxonol dye, hemioxonol dye, or hemicyanine dye.

31. A photographic element according to claim 1, wherein the fragmentable electron donor compound is of the formula:

$$A—(X—Y')_k$$

or $$(A)_k—X—Y'$$

wherein: A is a silver-ion ligand moiety or a cationic surfactant moiety.

32. A photographic element according to claim 31, wherein A is selected from the group consisting of: i) sulfur acids and their Se and Te analogs, ii) nitrogen acids, iii) thioethers and their Se and Te analogs, iv) phosphines, v) thionamides, selenamides, and telluramides, and vi) carbon acids.

33. A photographic element comprising a support and at least one blue sensitive silver halide emulsion layer containing a tabular grain silver halide emulsion spectrally sensitized with at least one dye providing a peak sensitization between 446 and 500 nm and at least one dye providing a peak sensitization between 400 and 445 nm and additionally sensitized with a fragmentable electron donor of the formula:

Q—X—Y' wherein Q represents a chromophoric system comprising a cyanine, complex cyanine, hemicyanine, merocyanine, or complex merocyanine dye;

X is an electron donor moiety, Y' is a leaving proton H or a leaving group Y, with the proviso that if Y' is H a base, β, is covalently linked directly or indirectly to X and wherein:

1) X—Y' has an oxidation potential between 0 and about 1.4 V; and
2) the oxidized form of X—Y' fragments to give the radical $X^{\bullet}$ and the leaving fragment Y'; and, optionally,
3) the radical $X^{\bullet}$ has an oxidation potential <0.7 V.

34. A photographic element comprising a support and at least one blue sensitive silver halide emulsion layer containing a tabular grain silver halide emulsion spectrally sensitized with at least one dye providing a peak sensitization between 446 and 500 nm and at least one dye providing a peak sensitization between 400 and 445 nm and additionally sensitized with a fragmentable electron donor of the formula X—H or an electron donor which contains an —X—H moiety;

wherein

X is an electron donor moiety to which a base $\beta^-$ is directly or indirectly covalently linked, H is a hydrogen atom and wherein:

1) X—H has an oxidation potential between 0 and about 1.4 V; and
2) the oxidized form of X—H fragments to give the radical $X^{\bullet}$ and the leaving proton $H^+$; and, optionally,
3) the radical $X^{\bullet}$ has an oxidation potential ≦0.7 V.

35. A photographic element according to claim 34, wherein X is of structure (I):

(I)

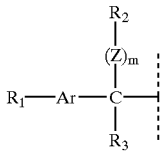

$R_1$=R, carboxyl, amide, sulfonamide, halogen, $NR_2$, $(OH)_n$, $(OR')_n$, or $(SR)_n$;

R'=alkyl or substituted alkyl;

n=1–3;

$R_2$=R, or Ar';

$R_3$=R, or Ar';

$R_2$ and $R_3$ together can form a 5- to 8-membered ring:

Ar=aryl group;

m=0, or 1;

Z=O, S, Se, or Te;

$R_2$ and Ar= can be linked to form a 5- to 8-membered ring;

$R_3$ and Ar= can be linked to form a 5- to 8-membered ring;

Ar'=aryl group, or heterocyclic group; and

R=a hydrogen atom or an unsubstituted or substituted alkyl group.

36. A photographic element according to claim 35, wherein the compound of Structure (I) is selected from:

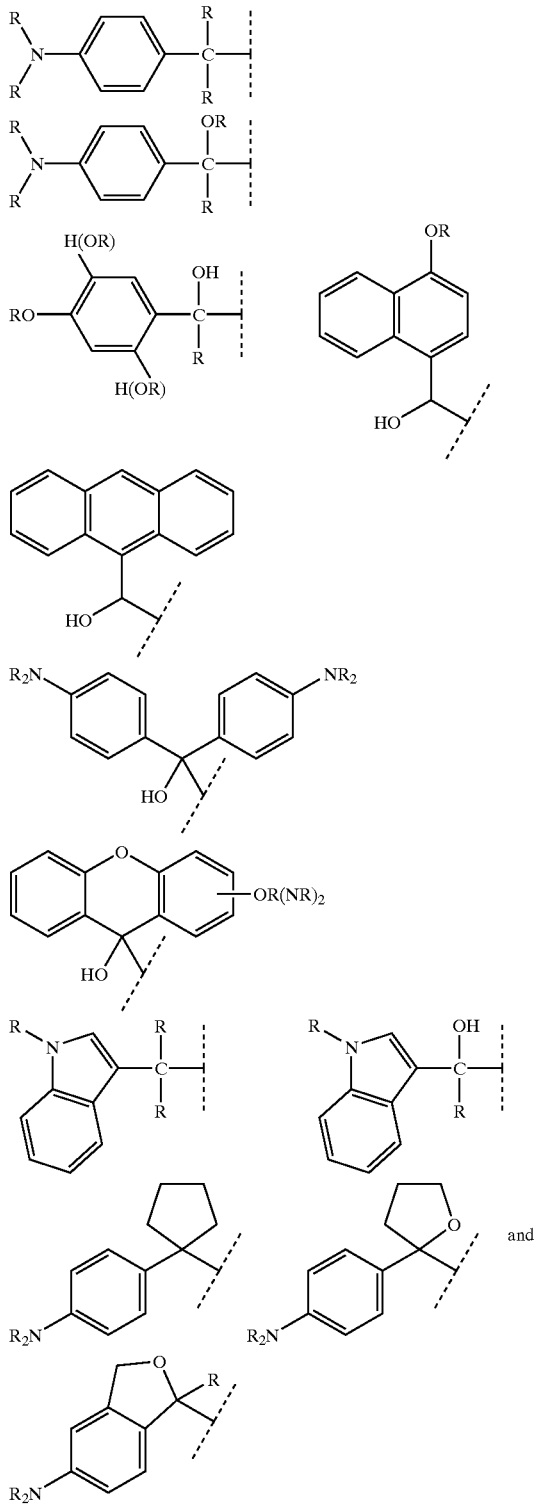

and wherein R=a hydrogen atom or an unsubstituted or substituted alkyl group.

37. A photographic element according to claim 34, wherein X is a compound of structure (II):

(II)

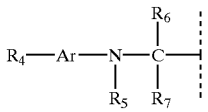

wherein:

Ar=aryl group;

$R_4$=a substituent having a Hammett sigma value of −1 to +1;

$R_5$=R, or Ar';

$R_6$=R, Ar' or, if $R_6$ is linked to Ar, $R_6$ can be a hetero atom;

$R_7$=R, or Ar';

$R_5$ and Ar═ can be linked to form a 5- to 8-membered ring;

$R_6$ and Ar═ can be linked to form a 5- to 8-membered ring;

$R_5$ and $R_6$ can be linked to form a 5- to 8-membered ring;

$R_6$ and $R_7$ can be linked to form a 5- to 8-membered ring;

Ar'=aryl group; and

R=hydrogen atom or an unsubstituted or substituted alkyl group.

38. A photographic element according to claim 34, wherein X is a compound of structure (III):

(III)

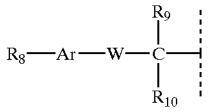

wherein:

W=O, S, or Se;

Ar=aryl group or heterocyclic group;

$R_8$=R, carboxyl, $NR_2$, $(OR)_n$, or $(SR)_n$ (n=1–3);

$R_9$ and $R_{10}$=R, or Ar';

$R_9$ and Ar═ can be linked to form a 5- to 8-membered ring;

Ar'=aryl group; and

R=a hydrogen atom or an unsubstituted or substituted alkyl group.

39. A photographic element according to claim 38, wherein X is selected from:

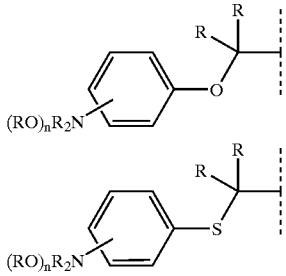

-continued

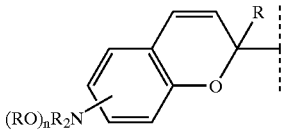

and n = 1–3

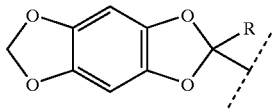

R=a hydrogen atom or an unsubstituted or substituted alkyl group.

40. A photographic element according to claim 34, wherein X is of structure (IV):

(IV)

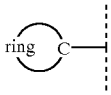

wherein:

"ring" represents a substituted or unsubstituted 5-, 6- or 7-membered unsaturated ring.

41. A photographic element according to claim 40, wherein X is selected from:

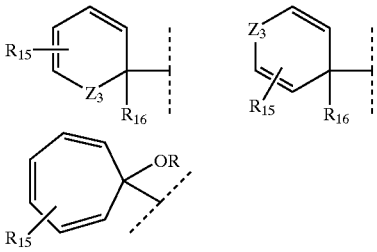

and $Z_3$=O, S, Se, or NR;

$R_{15}$=R, OR, or $NR_2$;

$R_{16}$=alkyl, substituted alkyl; and

R=a hydrogen atom or an unsubstituted or substituted alkyl group.

42. A photographic element according to claim 34, wherein the dye providing a peak sensitization between 446 and 500 nm is of formula (VII)

(VII)

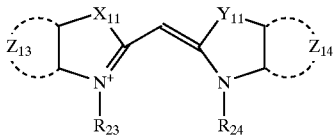

wherein:

$Z_{13}$ and $Z_{14}$, independently represent the atoms necessary to complete a substituted or unsubstituted benzene or naphthylene;

$X_{11}$ and $Y_{11}$ are independently O, S, Se or $NR_{25}$, wherein $R_{25}$ is an alkyl, alkenyl, aryl, any of which may be substituted or unsubstituted;

$R_{23}$ and $R_{24}$ independently represent and alkyl, alkenyl or aryl, any or which may be substituted or unsubstituted.

43. A photographic element according to claim 34, wherein the dye providing a peak sensitization between 400 and 445 nm is of structure (VI):

(VI)

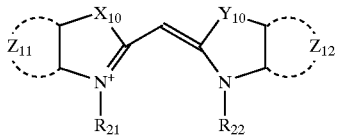

wherein:

$Z_{11}$ and $Z_{12}$ independently represent the atoms necessary to complete a substituted or unsubstituted benzene or naphthylene;

$X_{10}$ and $Y_{10}$, are independently O, S, Se or $NR_{25}$, provided that at least $X_{10}$ or $Y_{10}$ is O or $NR_{25}$, wherein $R_{25}$ is an alkyl, alkenyl or aryl any of which may be substituted or unsubstituted;

$R_{21}$ and $R_{22}$ independently represent an alkyl, alkenyl or aryl group any of which may be substituted or unsubstituted.

44. A photographic element according to claim 43, wherein the dye of structure (VI) is of structure (VIa) or (VIb):

(VIa)

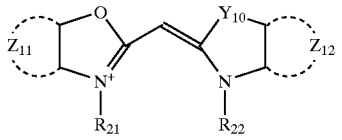

(VIb)

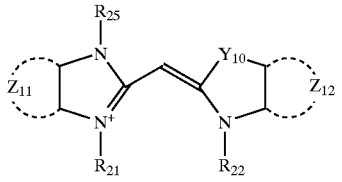

wherein:

$Z_{11}$ and $Z_{12}$ independently represent the atoms necessary to complete a substituted or unsubstituted benzene or naphthylene;

$Y_{10}$, is O, S or Se $R_{25}$ is an alkyl, alkenyl or aryl, any of which may be substituted or unsubstituted;

$R_{21}$ is and $R_{22}$ independently represent an alkyl, alkenyl or aryl group any of which may be substituted or unsubstituted.

45. A photographic element according to claim 34, wherein the tabular grains have thicknesses of <0.3 $\mu$m.

46. A photographic element according to claim 34, wherein the tabular grains have a thickness of <0.07 $\mu$m.

47. A photographic element comprising a support and at least one blue sensitive silver halide emulsion layer containing a silver halide emulsion in which the halide content is at least about 50% chloride and no more than 5% iodide, wherein the emulsion is spectrally sensitized with at least one dye providing a peak sensitization between 446 and 500 nm and at least one dye providing a peak sensitization between 400 and 445 nm and is additionally sensitized with a fragmentable electron donor of the formula X—H or an electron donor which contains an —X—H moiety;

wherein

X is an electron donor moiety to which a base $\beta^-$ is directly or indirectly covalently linked, H is a hydrogen atom and wherein:

1) X—H has an oxidation potential between 0 and about 1.4 V; and 2) the oxidized form of X—H fragments to give the radical $X^{\bullet}$ and the leaving proton $H^+$; and, optionally, 3) the radical $X^{\bullet}$ has an oxidation potential $\leqq$0.7V.

* * * * *

UNITED STATES PATENT AND TRADEMARK OFFICE

CERTIFICATE OF CORRECTION

PATENT NO. : 6,509,144 B1 
DATED : January 21, 2003
INVENTOR(S) : Kenneth J. Reed et al.

It is certified that error appears in the above-identified patent and that said Letters Patent is hereby corrected as shown below:

Title page,
Item [*] Notice, insert -- This patent issued on a continued prosecution application filed under 37 CFR 1.53(d), and is subject to the twenty year patent term provisions of 35 U.S.C. 154(a)(2). --

Signed and Sealed this

Seventeenth Day of June, 2003

JAMES E. ROGAN
*Director of the United States Patent and Trademark Office*